US009601061B2

(12) United States Patent
Monteiro

(10) Patent No.: US 9,601,061 B2
(45) Date of Patent: Mar. 21, 2017

(54) METHOD AND MEANS TO PREVENT DARK LINES WITHIN THE IMAGE SPACE OF LIGHTED BILLBOARDS AND OTHER PUBLIC DISPLAY DEVICES

(71) Applicant: Sergio Lara Pereira Monteiro, Los Angeles, CA (US)

(72) Inventor: Sergio Lara Pereira Monteiro, Los Angeles, CA (US)

( * ) Notice: Subject to any disclaimer, the term of this patent is extended or adjusted under 35 U.S.C. 154(b) by 0 days.

(21) Appl. No.: 15/235,616

(22) Filed: Aug. 12, 2016

(65) Prior Publication Data

US 2016/0351134 A1 Dec. 1, 2016

Related U.S. Application Data

(63) Continuation-in-part of application No. 14/929,816, filed on Nov. 2, 2015, which is a continuation-in-part of application No. 14/530,635, filed on Oct. 31, 2014, now Pat. No. 9,218,759.

(60) Provisional application No. 61/899,147, filed on Nov. 1, 2013, provisional application No. 61/910,096, filed on Nov. 28, 2013, provisional application No. 62/188,737, filed on Jul. 5, 2015.

(51) Int. Cl.

| | |
|---|---|
| ***G09G 3/34*** | (2006.01) |
| ***G09G 3/36*** | (2006.01) |
| ***G09G 3/00*** | (2006.01) |

(52) U.S. Cl.

CPC ..... *G09G 3/3413* (2013.01); *G09G 3/00* (2013.01); *G09G 3/3607* (2013.01); *G09G 2300/026* (2013.01); *G09G 2300/0439* (2013.01); *G09G 2300/0452* (2013.01); *G09G 2320/02* (2013.01); *G09G 2320/064* (2013.01); *G09G 2380/04* (2013.01)

(58) Field of Classification Search

CPC ..... G09G 2300/026; G06F 3/1446; H04N 9/3108

USPC ..... 345/1.2, 82

See application file for complete search history.

(56) References Cited

U.S. PATENT DOCUMENTS

| | | | | |
|---|---|---|---|---|
| 5,410,328 | A * | 4/1995 | Yoksza | G09F 9/33 345/82 |
| 7,605,772 | B2 * | 10/2009 | Syrstad | G09F 9/33 315/169.3 |
| 7,877,910 | B2 * | 2/2011 | Thorjussen | G09G 3/001 116/200 |
| 8,111,208 | B2 * | 2/2012 | Brown | G09F 9/33 340/815.45 |

(Continued)

*Primary Examiner* — Chad Dicke

(57) ABSTRACT

Most large public displays systems are built with smaller modules populated with light emitting pixels devices which are then connected together to form a larger surface which is the combined surface area of all the modules. This construction method creates the problem that the supporting and connecting structure that holds the modules together uses a generally small but not totally negligible space between each pair of modules, which is devoid of light emitting pixel devices, which, in turn creates a darker space between the modules. This problem is aggravated by the fact that the modules are generally rectangular, which causes that their edges continue from edge to edge of the whole display, causing darker lines on the display surface, generally horizontal and vertical darker lines. This invention discloses adding light emitting pixel devices on the supporting and connecting structure so that the image is continuous across the full display area.

20 Claims, 22 Drawing Sheets

(56) References Cited

U.S. PATENT DOCUMENTS

Figure 1:
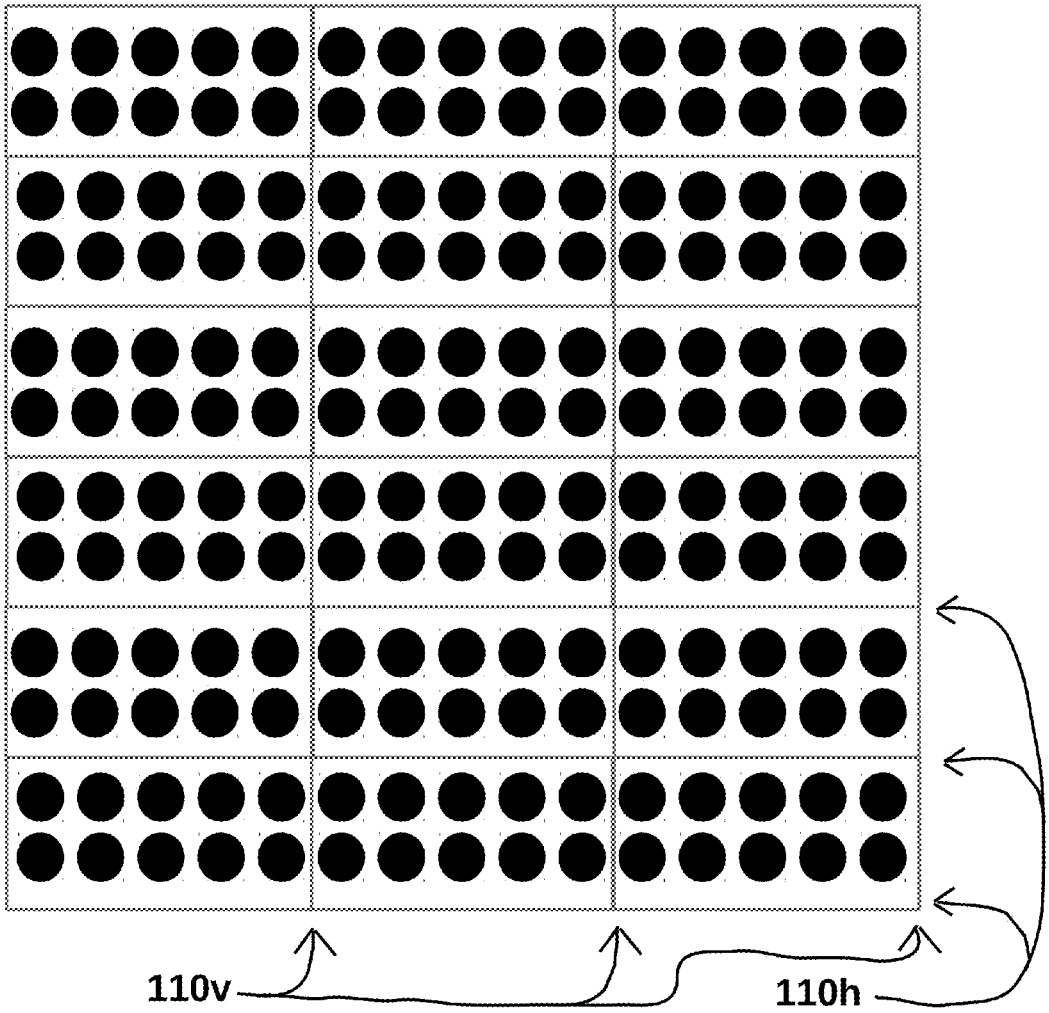

2002/0126086 A1* 9/2002 Takeuchi ..... G09F 9/305 345/156
2003/0146891 A1* 8/2003 Poliakine ..... G06F 3/1446 345/87
2005/0052374 A1* 3/2005 Devos ..... F16B 5/0664 345/82
2006/0075666 A1* 4/2006 Thielemans ..... G06F 3/14 40/448
2008/0174515 A1* 7/2008 Matthies ..... G02F 1/13336 345/1.3
2009/0277056 A1* 11/2009 Peeters ..... G02B 5/24 40/406
2009/0289160 A1* 11/2009 Kludt ..... F16B 2/12 248/226.11
2009/0310337 A1* 12/2009 Patterson ..... G06F 3/1446 362/97.1
2010/0123380 A1* 5/2010 Lee ..... F21S 2/005 313/1
2011/0025594 A1* 2/2011 Watanabe ..... G02F 1/13336 345/102
2013/0082901 A1* 4/2013 Watanabe ..... G02F 1/13336 345/1.3
2013/0176352 A1* 7/2013 Watanabe ..... G09G 3/34 345/690
2014/0016301 A1* 1/2014 Brown Elliott ... G02F 1/133603 362/97.1
2014/0056003 A1* 2/2014 Frattalone ..... F21K 9/30 362/249.06
2014/0137384 A1* 5/2014 Patterson ..... G06F 3/1446 29/428
2014/0184472 A1* 7/2014 Xia ..... G06F 3/1446 345/1.3
2014/0225808 A1* 8/2014 Kline ..... G09F 9/33 345/1.3

* cited by examiner

METHOD AND MEANS TO PREVENT DARK LINES WITHIN THE IMAGE SPACE OF LIGHTED BILLBOARDS AND OTHER PUBLIC DISPLAY DEVICES

CROSS-REFERENCE TO RELATED APPLICATIONS

This patent application is a continuation-in-part of U.S. patent application Ser. No. 14/929,816, application date Nov. 2, 2015, published as US patent number 2016-0133182-A1 on May 12, 2016, now abandoned, which is a continuation-in-part of U.S. patent application Ser. No. 14/530,635, application date Oct. 31, 2014, published as US patent number 2015-0124008-A1 on May 7, 2015, now U.S. Pat. No. 9,218,759 issued on Dec. 22, 2015. This patent application is based on and claims priority to three previously filed U.S. Provisional Patent Applications, No. 61/899,147 filed on Nov. 1, 2013, 61/910,096 filed on Nov. 28, 2013, and 62/188,737, filed on Jul. 6, 2015, the priority and benefit of which is now claimed under 35 U.S.C. par. 119(c) and incorporated to this text by reference in its entirety, in particular their claims, description and figures.

FEDERALLY SPONSORED RESEARCH

Not applicable.

SEQUENCE LISTING OR PROGRAM

Not applicable.

BACKGROUND OF THE INVENTION

Field of Invention

This invention relates to the field of display devices, particularly active display devices, formed by small light emitting elements (pixels), the aggregate of which forms a display image, including characters, and in particular to the displays which are organized in pixels which are typically arranged in rows and columns over the surface of the display area, sometimes as a checkerboard (x-y arrangement or chess-board). The invention discloses a method and a system to forestall the formation of continuous lines of light elements, often distinguishable in the image, which are visually disturbing because the true image is continuous with no streaks across it.

BACKGROUND OF THE INVENTION

Discussion of Prior Art

For better understanding of the description that follows we want to clearly define some terms used in what follows. Artifact: as used here and in technology, the term means an unwanted, and usually undesirable and deleterious change on the result produced as a consequence of the particular method used to measure or to detect something. In this sense the term is used mostly by researchers in laboratories and departs from the ordinary English dictionary meaning of it. Variously spelled as "artifact" and "artefact".

Checkerboard arrangement: a horizontal-vertical arrangement of squares, as the ones on a checkerboard or chess board or tic-tac-toe grouping of squares. Used here to indicate an equivalent arrangement of pixels (q.v.), also called here x-y arrangement or a matrix type arrangement. If the notation x-y is used, usually x-lies along the horizontal direction (or rows) and y-lies along the vertical direction (or columns). Cf. With 2-D hexagonal close-packed arrangement (2Dhcp), with pseudo hexagonal close-packed arrangement and with pseudo-checkerboard arrangement.

2-D Hexagonal close-packed arrangement (2Dhcp): On a surface described by a standard x-y Cartesian coordinate system, the 2Dhcp is a geometrical distribution of equal circular elements on a surface such that subsets of the equal elements are arranged on horizontal lines characterized by the same y-coordinate, and each horizontal line is occupying such a position that the x-coordinate of each of its elements is at the average horizontal (x) coordinate as the coordinates of the elements to its right and left on the lines just above and below it. The 2dhcp arrangement packs the maximum number of circles on any given surface. Cf Checkerboard arrangement and pseudo hexagonal close-packed arrangement and pseudo checkerboard arrangement.

first plurality of light emitting device pixels—pixels populating the modules. These also generally make most of the image but not all the image, part of which is at the space used by the supporting structure around the modules. (cf. Second plurality of light emitting device pixels)

First partial image: the part of the displayed image that is made with the first plurality of light emitting device pixels (q.v.) that populate the surface of the display modules. Cf with second partial image. The complete displayed image is a combination of the first and second partial images.

Line of pixels: We arbitrarily define a line of pixels as a straight line passing by a plurality of light emitting device pixels within the centers of the pixels plus or minus 5% (5 percent) of the radius of the pixels. Note that this is an engineering definition of a line, allowing for imperfections on the pixel position, as opposed to the mathematical definition of a line, which is perfect.

Neighborhood of a pixel: We arbitrarily define here the neighborhood of a light emitting device pixel as a circle around the center of the light emitting device pixel with radius equal to 5% (5/100) of the distance between the two closest of the light emitting device pixels of the set.

Pixel (also light emitting device pixel): An elementary light emitter which is small enough that it is hardly distinguishable from its neighbor pixels from the intended viewing distance. A pixel may be a combination of several individual light emitters of different colors, as red-green-blue (RGB). When referring to color images, composed of a combination of three or more individual light emitter of different colors, there is no universal agreement on the usage of the word. Some use pixel meaning the group RGB, while others use pixel meaning each individual emitter. Also used for an elementary light detector, as a the individual light detectors in a digital camera. Associated with Pixelized: the quality of a image or display which is made from pixels.

Position of pixel: We call the position of each pixel as the point where is located the geometric center of the single or multiple light emitting devices corresponding to the pixel.

Pseudo checkerboard arrangement: An arrangement of light emitting device pixels which includes one or more deviations from the checkerboard arrangement. Variations may include two rows (or lines) following an hexagonal close-packed arrangement, two rows (or lines) at a distance larger than the minimum distance characteristic of the ckeckerboard arrangement, or other partial departure from the true checkerboard arrangement. Such internal departures from the ideal contribute to forestall line continuations from one module to the neighboring module(s). Cf. hexagonal close-packed arrangement, pseudo hexagonal close-packed arrangement and with checkerboard arrangement.

Pseudo hexagonal close-packed arrangement: An arrangement of light emitting device pixels which includes one or more deviations from the hexagonal close-packed arrangement. Variations may include two rows (or lines) following a checkerboard arrangement, two rows (or lines at a distance larger than the minimum distance characteristic of the hexagonal close-packed arrangement, or other partial departure from the true hexagonal close-packed arrangement. Such internal departures from the ideal contribute to forestall line continuations from one module to the neighboring module(s). Cf. Hexagonal close-packed arrangement, with checkerboard arrangement and pseudo checkerboard arrangement.

Radius of the pixels: We arbitrarily define the radius of a pixel as the smallest distance between a pixel and any of its neighbors.

Second plurality of light emitting device pixels—pixels populating the fasteners that join the modules together. The second plurality of light emitting devices contribute for the total image, which is formed mostly by the first plurality of light emitting devices, because they define a larger area, but also, as a minor component because, and only because, it encompass a minor part of the total surface, by the second plurality of light emitting devices. (cf. First plurality of light emitting device pixels).

Second partial image: the part of the displayed image that is made with the second plurality of light emitting device pixels (q.v.). Cf with first partial image. The complete displayed image is a combination of the first and second partial images.

Supporting devices/fastener (60_Fastener) mechanical supports for the modules, intended to keep the modules together, already in use by the existing displays (prior art in patent parlance). The supporting devices play a crucial role in this invention, which discloses a method and means to support the second light emitting pixels at the surface of the supporting devices, with the objective of forestalling the existence of no-light lines, or darker lines, in-between each pair of neighboring module. In other words, the supporting devices (60_Fastener) contain pixels that contribute for the image displayed by the whole system—the second plurality of device pixels. These pixels at the supporting devices 60_Fastener are not just light fillers to hide dark lines in between the modules, but these pixels do contribute for the actual complete image, which is spread between the first and the second light emitting device pixels. Some of the image pixels are attached to the modules, while some of the image pixels are attached to the supporting devices 60_Fastener.

The field of pixelized displays has been characterized by displays which consisted of light elements (pixels) usually arranged in repeating rows and columns, as a matrix (or x-y, or checkerboard). The rows and columns are usually evenly spaced, but sometimes the horizontal (x) separation is not the same as the vertical (y) separation. This choice of evenly spaced horizontally and vertically arranged pixels occurred because it is less expensive and easier to manufacture such a type of display on such an organized array than a display with randomly positioned pixels, as are, for example, the pixels on a pointillist painting by Georges Seurat, in which the individual dots were randomly arranged, besides being of variable size. The economic advantage of smaller price of manufacture comes at the price of decreased image quality—after all, there was a good reason, a very good reason indeed, why Seurat and the other pointillist painters never used colored dots on evenly spaced rows and columns as current manufactured lighted displays do. But alas, theirs was a work of art, while pixelized light emitting displays are work of money! Still, one is tempted to improve the quality of displays made for money—how much better life would be if billboards displayed works of art instead of advertisements for products that are not even needed. It is difficult to improve on Seurat's paintings, but it is easy to improve on the poorly conceived work of money—though the inventors can't help other than to wonder if it is worth to do this, to improve the visual quality of advertising boards.

FIG. 1 shows a simplified example of existing devices pixelized display (old art in patent attorneys' parlance). FIG. 1 depicts very very few pixels for simplicity. In it one sees a simplified display of the type used for outdoor advertisement in the United States: a vertically oriented display designed for street announcements, typically measuring 20 meters horizontally by 5 meters vertically. The light emitting elements (pixels) may be spaced 1 cm center-to-center, spaced in both the horizontal and vertical dimensions, making a total of 2,000 by 500 pixels for a display measuring 20 meters wide by 5 meters high (approximately 60 ft by 15 ft), but these are just typical dimensions, actual values varying substantially from model to model, these values not being used to limit my invention, but only to give a general idea of the typical existing devices. In the simplified display shown at FIG. 1 there are 18 modules making an array of 3 by 6 modules, 15 total pixels on the horizontal direction and 12 total pixels on the vertical direction, each module having 10 pixels with 2 rows and 5 columns each. Most of the existing street announcing devices use LEDs with brightness from 5,000 to 10,000 cd/m-squared, but this is not a limitation of the current invention. The display is supported in the vertical position by a suitable structure located behind and around it, behind and around the light emitting surface, which is then freely visible from the front of the display. The supporting structure behind the light emitting elements also carry the electrical power wires and all the required electronics. A controlling computer is usually at the ground, in a more accessible location than the display, which typically is high to increase visibility.

The light emitting surface is typically subdivided in modules that are designed for easy industrial production, typically of rectangular or square shape. These modules may typically have dimensions of the order of a foot (30 cm), for example, 20 cm by 40 cm. FIG. 1 displays rectangular modules as an example. Each module is in turn composed of a large number of relatively small light emitters, typically three types of emitters, capable of emitting three distinct colors, typically red, green and blue (RGB), but variations are possible and in use, 2 reds, 1 green and 1 blue per pixel or RRGB, also RGB with a white LED, or RGBW being very common. Inside each module, the light emitters, or pixels, are usually arranged in rows and columns, and the modules themselves are arranged in rows and columns too, as per FIG. 1, so the whole arrangement creates various levels of rows and columns of light distribution. As described below, out invention discloses a method and a system to break these lines of light. In FIG. 1 the modules are rectangular with 2 rows and 5 columns of pixels.

Figure 2:
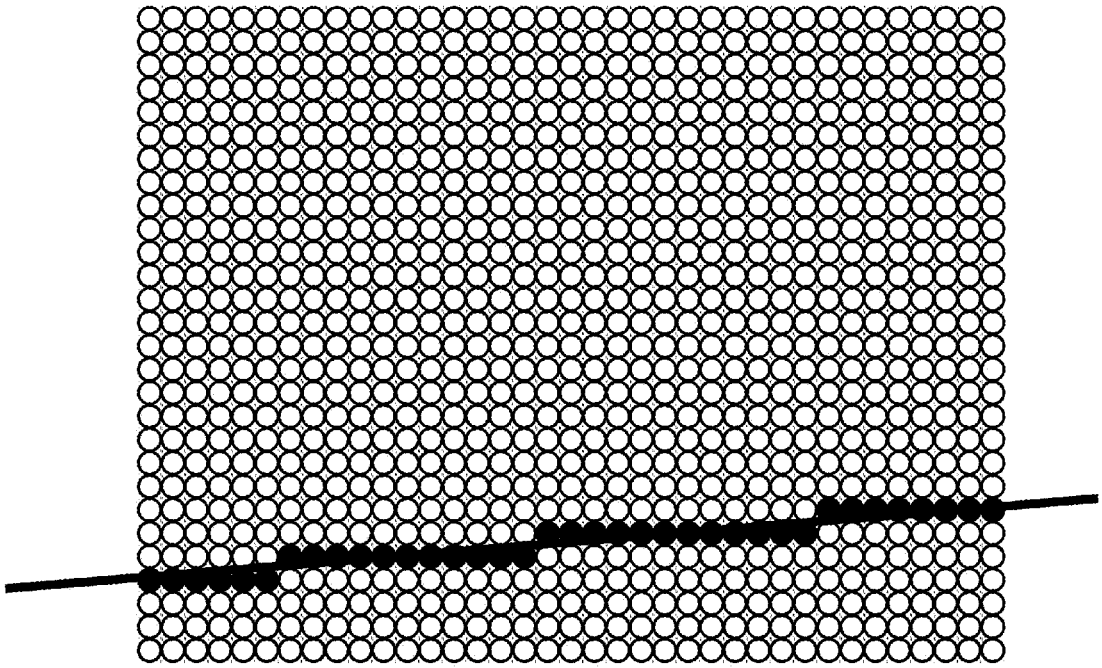

FIG. 2 depicts the visual effect of a line with a small inclination with the horizontal direction. Due to the small inclination (slope in mathematics), what is a slowly increasing y-coordinate is depicted with the same y-coordinate for several contiguous pixels, forming a short horizontal line, the full line being then depicted as a series of short horizontal steps which are visually disturbing to the viewer for being so unnatural.

Isaac Newton was the first to notice that an appropriate mixture of three colors is capable of creating the visual impression on humans of all the colors, which he demonstrated with his Newton color wheel, a fact that today is easy to predict once it is know that the human eye (and many other mammals as well) has three types of different cone shaped detectors capable of responding to three different colors—actually three different maximum responses at three different colors, which overlap. For lighted advertising displays, designed to prod people to buy objects that they do not need, an appropriate combination of each of these colors at a continuously varying light intensity, is capable of creating a suitable variety of colored dots, the aggregate of which produces an image when viewed from and beyond a certain distance, which depends on the size of the pixels used for the display.

As examples of the decreased image quality we can cite:

1. if a particular feature falls on a line that also happens to be thin and horizontal, the display procedure could consider the lighted points to fall in between the existing pixels and ignore the line, which would then not be shown, or could display it using all pixels above the actual line and all pixels below the actual line, therefore increasing the line width, or could display it at a horizontal line just under the correct position, all options creating a deformed image.

2. same, mutatis mutandis, for a vertical line, 3. if a particular feature falls on a line which is at a small angle with the horizontal, given the impossibility of displaying points (pixels) at arbitrary vertical positions, the display would have to light a small horizontal segment followed by another small horizontal segment slightly higher, etc., etc., which causes a disturbing image of a stairway, 4. same, mutatis mutandis, for an off-vertical line.

The last two effects are disturbing because our brains are trained to detect the stair-case feature out of the background. It would be advantageous to have a display system that were not characterized by these artifacts.

OBJECTS AND ADVANTAGES

Accordingly, it is an object of the present invention to improve on the quality of the image displayed on a public announcer, as in an airport display or in a train station display, or in a conference display, as a street advertising board, or a highway announcer or the like.

It is another object of the present invention to decrease the artifacts created by light emitters located at repetitive arrangements on the surface of the announcing surface, as checker-board (x-y) arrangements, or other geometric arrangement.

It is a further object of the present invention to forestall the artificial visual impression of lines across the image, which are not part of the intended image but appear on the display because all the light emitters are arranged on linear geometric arrangements.

It is yet another object of the present invention to forestall the existence of spatial frequencies of light emitters, which cause the phenomenon known as Nyquist frequency folding, which results in the introduction of features in the image which are not part of the actual image, in effect changing the displayed image.

It is a further object of the present invention to forestall the (usually) dark lines that (usually) exist between flat display modules supported on their perimeter by an appropriate supporting structure which emits no light, where each flat display module display a part of the intended total image.

It is another further object of the present invention to forestall the (usually) dark lines around the modules caused by the supporting structure, that (usually) exist between each flat display module that display a part of an image, so that all display modules and all the surrounding supporting structure together display a total image. This object is achieved dividing the total image into a first partial image, or first part of the image, that is displayed by pixels at the modules and a second partial image, or second part of the image, that is displayed by pixels at the front face of the supporting structure around the modules.

It is another further object of the present invention to contribute for the dream of one day having billboards that display the mural paintings of Diego Rivera (as "Man, Controller of the Universe") or Francisco Goya (as "Los desastres de la guerra") instead of advertisements prodding the people to buy objects that they do not need and only serve to increase the volume of garbage.

Accordingly, it is an object of the present invention to decrease the artifacts introduced in images produced by light emitters regularly organized in rows and columns. Particularly the artificially produced visible continuous lines of light, particularly along the horizontal and vertical directions which are common in current types of lighted displays.

It is also another object of the present invention to allow the display of art works on billboards; the inventors get sad that mostly what will be displayed will be messages prodding the viewers to buy objects that they neither need nor want.

If one or more of the cited objectives is not achieved in a particular case, any one of the remaining objectives should be considered enough for the patent disclosure to stand, as these objectives are independent of each other.

SUMMARY

This invention discloses a method and system to forestall the formation of lines along certain directions, usually horizontal and vertical directions, on a pixelized image display, as there exists in street advertising boards and indoor/outdoor announcement boards, as in sports stadiums and arenas, airport and train station announcing boards, convention floor announcing boards, computer monitors and TV displays, classroom and convention room display devices, and other displays characterized by pixelized "dots" which are generally arranged along rows and columns. Of these, the street advertising boards and the convention floor announcing boards are the most conspicuous example of the offending characteristic, being the ones where the lines are most visible. Indoor information display boards, as in airport and train stations, have smaller pixels, and therefore the lines are less obvious than the lines on public advertisement billboards, and then computers and TV displays are nowadays produced with so small pixels that they are hardly perceptible though they can also be improved.

The lines across the image that are characteristic of current devices have also another disadvantage, which is the introduction of image features which are not part of the intended image, via the mechanism of Nyquist frequency folding.

DRAWINGS

FIG. 1. Existing type of pixelized display. The light emitting elements are organized in rows and columns, as in FIG. 8*b*. The reader is requested to notice that there are two types of lines with this current technology arrangement: (1)

the lines created by the pixel arrangement itself, and (2) the lines created by the borders of the modules (marked as 110 h and 110 v) which show as absence of light on the display.

FIG. 2. Schematic depiction of a "stairway" line caused by pixels at fixed heights, incapable of depicting a continuous variation of heights. The effect is more obvious with lines close to the horizontal or to the vertical directions.

Figure 3A:
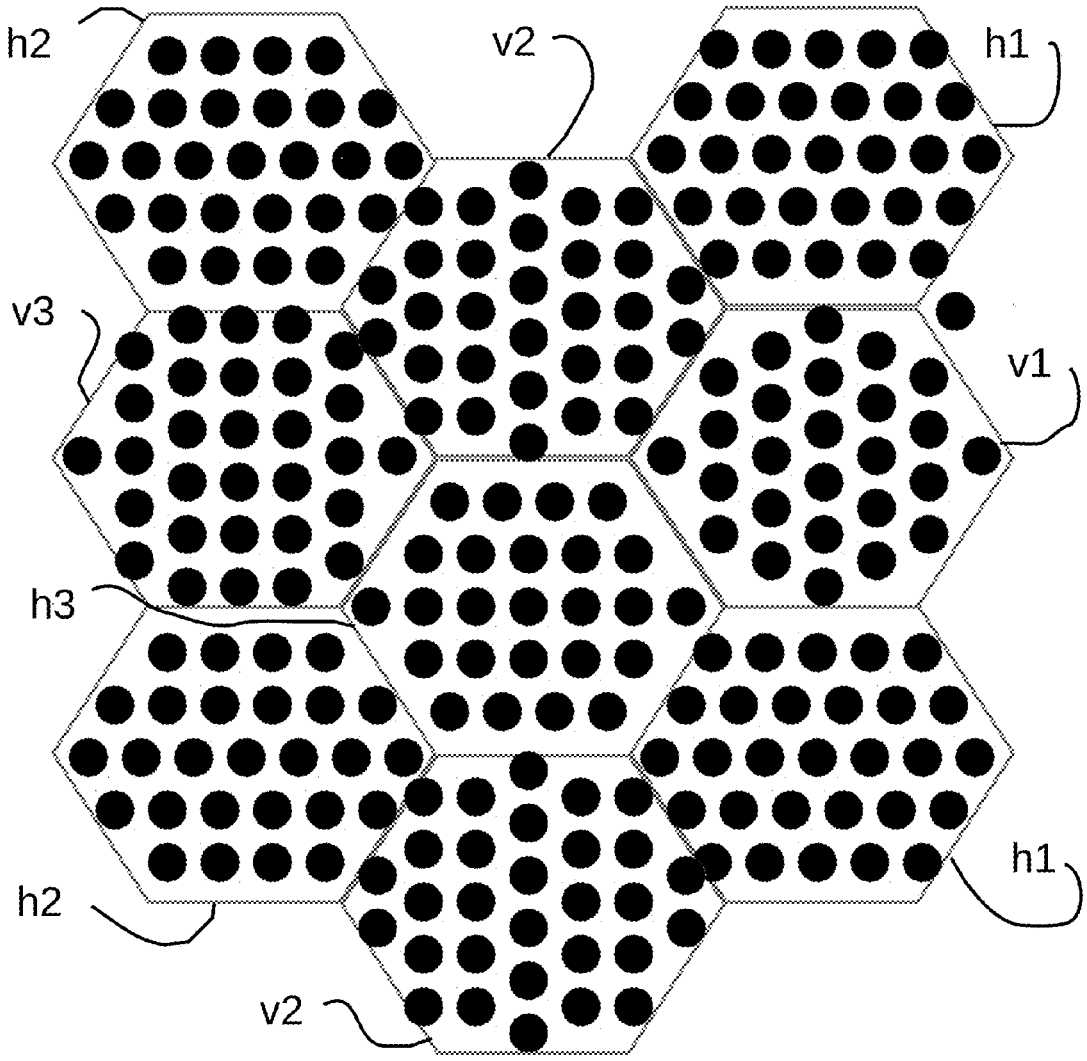

FIG. 3*a*. A small section of a large display composed of the hexagonally shaped module of our invention with some of the pixel distributions disclosed in our invention. The actual size ratio of pixel to hexagonal module size is exaggerated to conform to USPTO requirements and to better display the features explained. A typical actual hexagonal module would be 20 cm each side, each pixel 8 mm center-to-center separation, with a total of 50 pixels from corner to corner along the longest dimension and 44 pixels along any direction perpendicular to any pair of parallel sides—these being typical dimensions only, not intended to limit the description and the invention. Inside the hexagonally shaped modules, h1 and v1 contain pixels arranged in the hexagonal-close-packed arrangement, while h2, h3, v2 and v3 contain pixels arranged in a distribution that departs slightly from the hexagonal-close-packed arrangement, which we call pseudo-hexagonal-close-packed arrangement. The pseudo-hexagonal-close-packed arrangement may differ from the hexagonal-close-packed distribution on a single row or column, causing that all other row or columns are likewise displaced, or it may differ from the hexagonal-close-packed distribution on a few rows or columns.

Figure 3B:
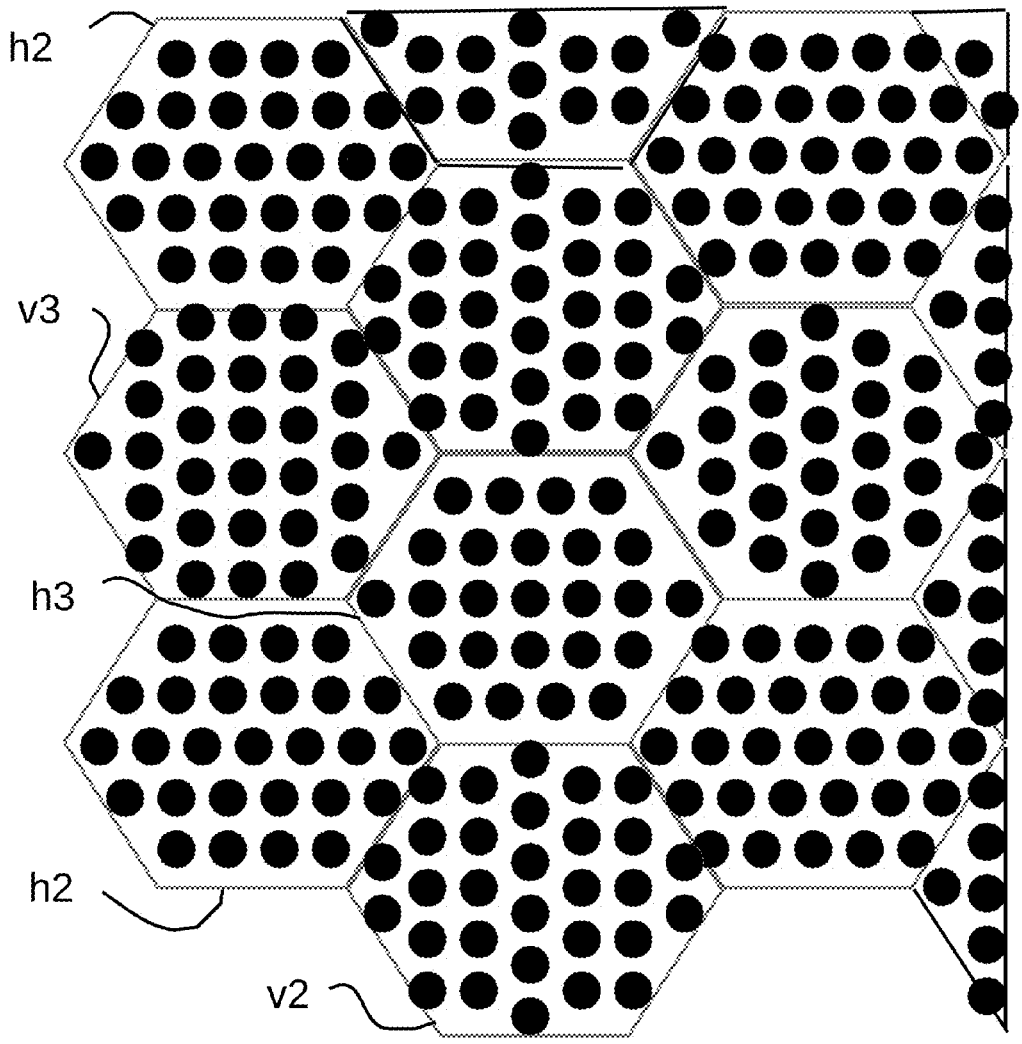

FIG. 3*b*. Same as FIG. 3*a* with some filling modules at the top and right of the displaying surface. Such extra, smaller modules would normally be used to make a straight edge display, but not necessarily, it being possible to manufacture a display exactly as FIG. 3*a*, with a "rough" edge.

Figure 4:
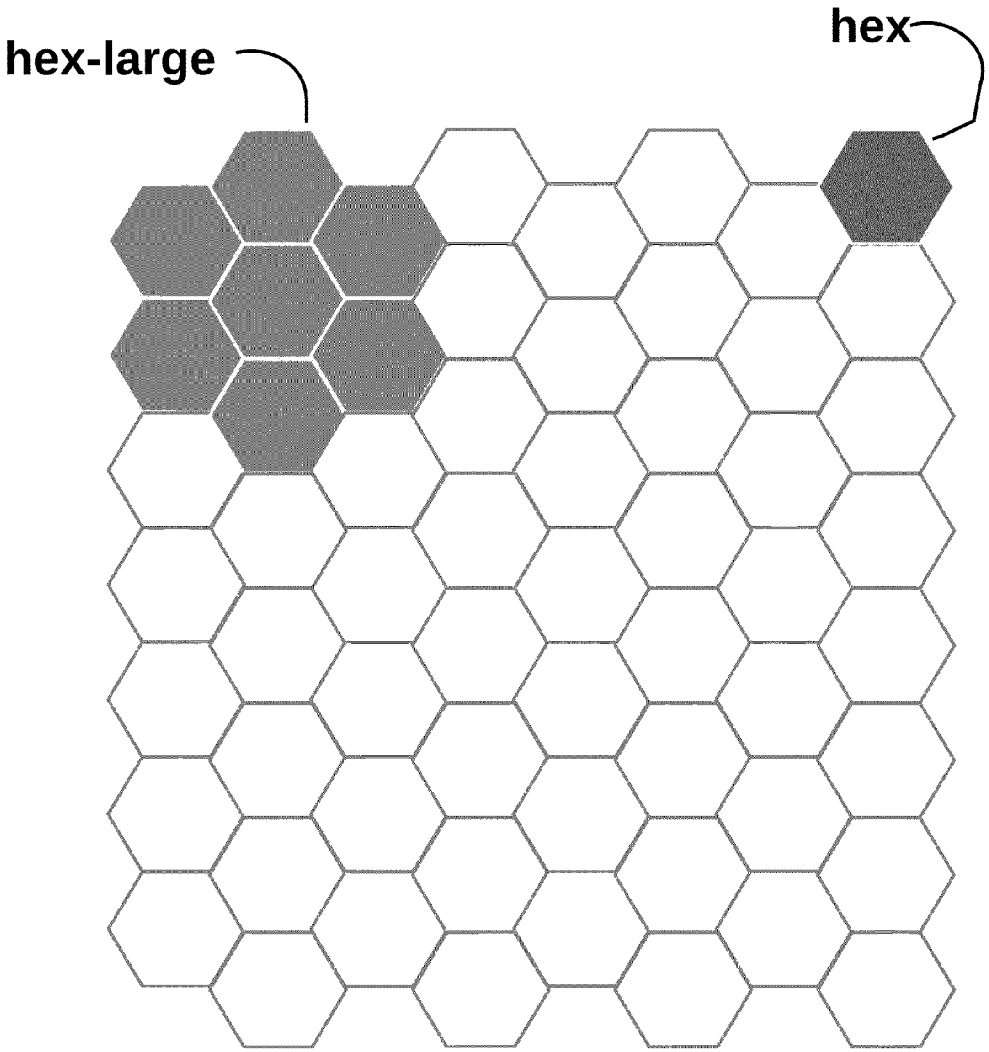

FIG. 4. Shows a larger number of hexagonal modules but not any LED inside them.

Figure 5:
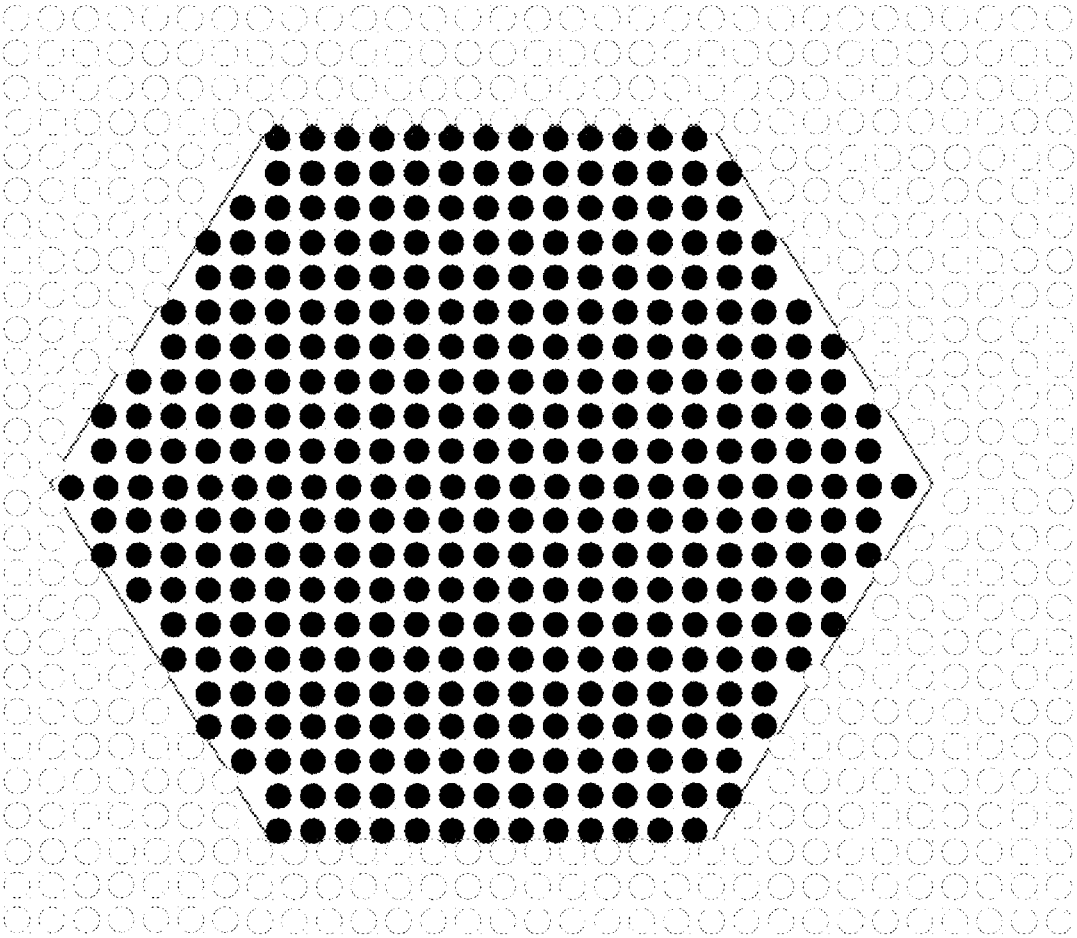

FIG. 5. A possible variation for pixel elements around a typical hexagon. In this case the pixel arrangement within each hexagonally shaped module is of the x-y (or checkerboard) type, but the distances from each pixel to the supporting structure varies by a fraction of the pixel-to-pixel separation (say 8 mm), so that there is no continuation of lines from one hexagonal module to the next. Other variations are possible, within the scope of our invention.

Figure 6:
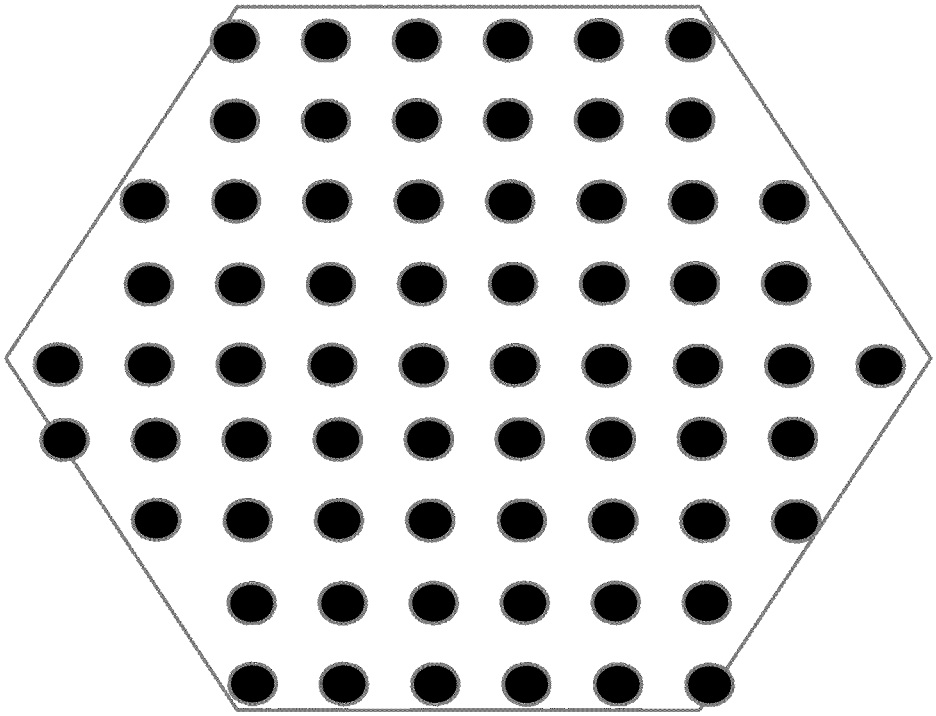

FIG. 6. Another view of light emitting pixels within a hexagonal module, but with larger pixels than displayed in FIGS. 3*a* and 3*b*, which enhances the intended feature. Note that, as in FIGS. 3*a* and 3*b*, the pixels are arranged in a x-y (or matrix-like) arrangement.

Figure 7:
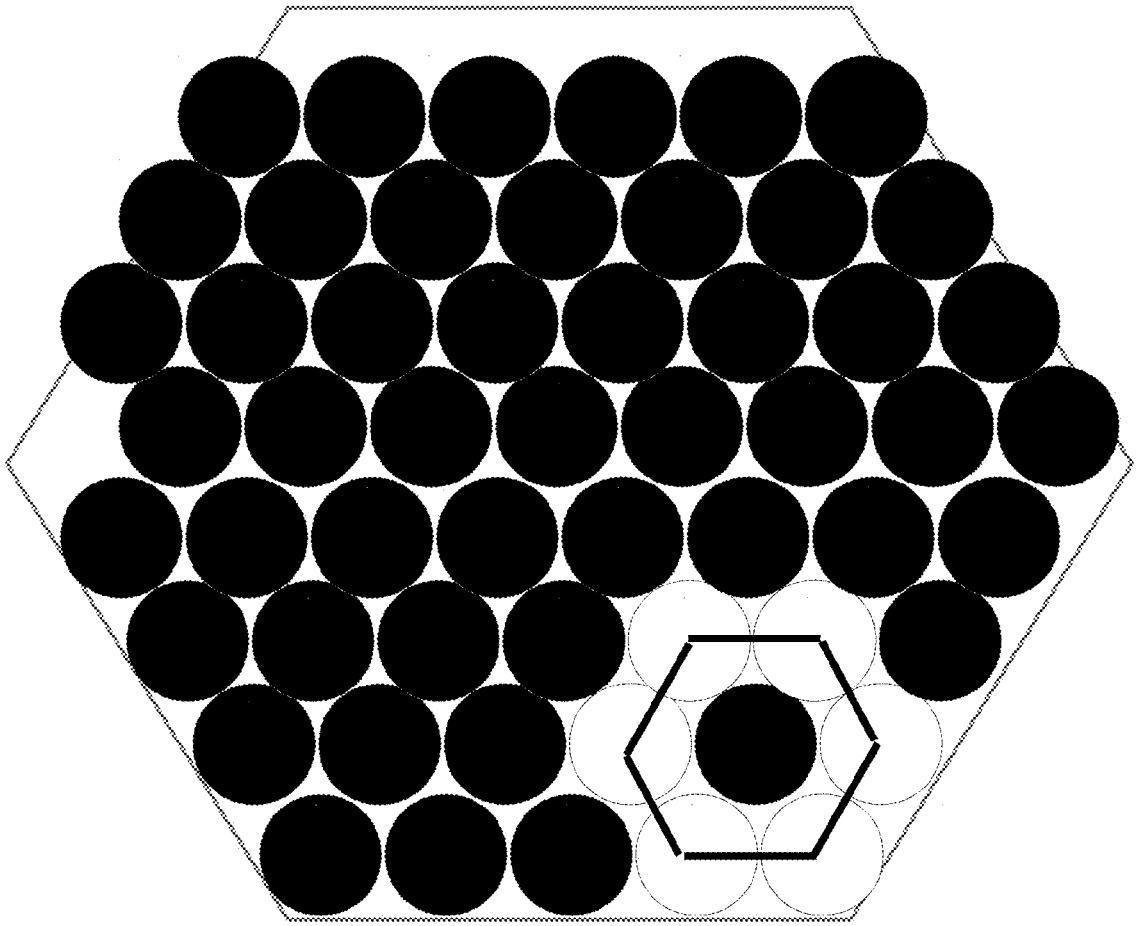

FIG. 7. A haxagonal-close-packed pixel arrangement inside a hexagonal module of our invention. The mismatch at the edges becomes exaggerated due to the oversized pixels to conform to drawing limitations. With actual relative dimensions of pixel size to module size the mismatch of pixels at the module edges is minimal and visually less disturbing than in this figure.

Figure 8A:
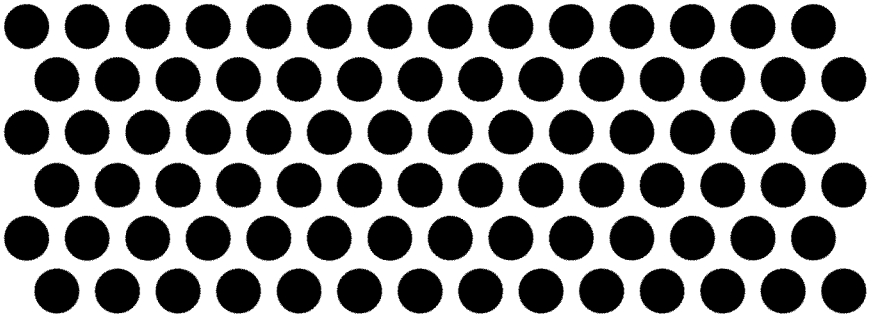

FIG. 8*a*. A hexagonal-close-packed arrangement of pixels. Note that the pixels in each row is half a separation in the horizontal direction between the pixels in the row above and below it.

Figure 8B:
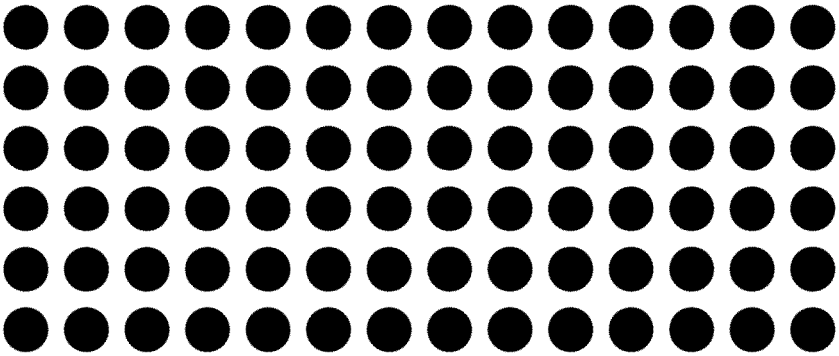

FIG. 8*b*. A checkerboard arrangement of pixels. Note that the pixels in each row is exactly below and above the pixels in the row above and below it.

Figure 9:
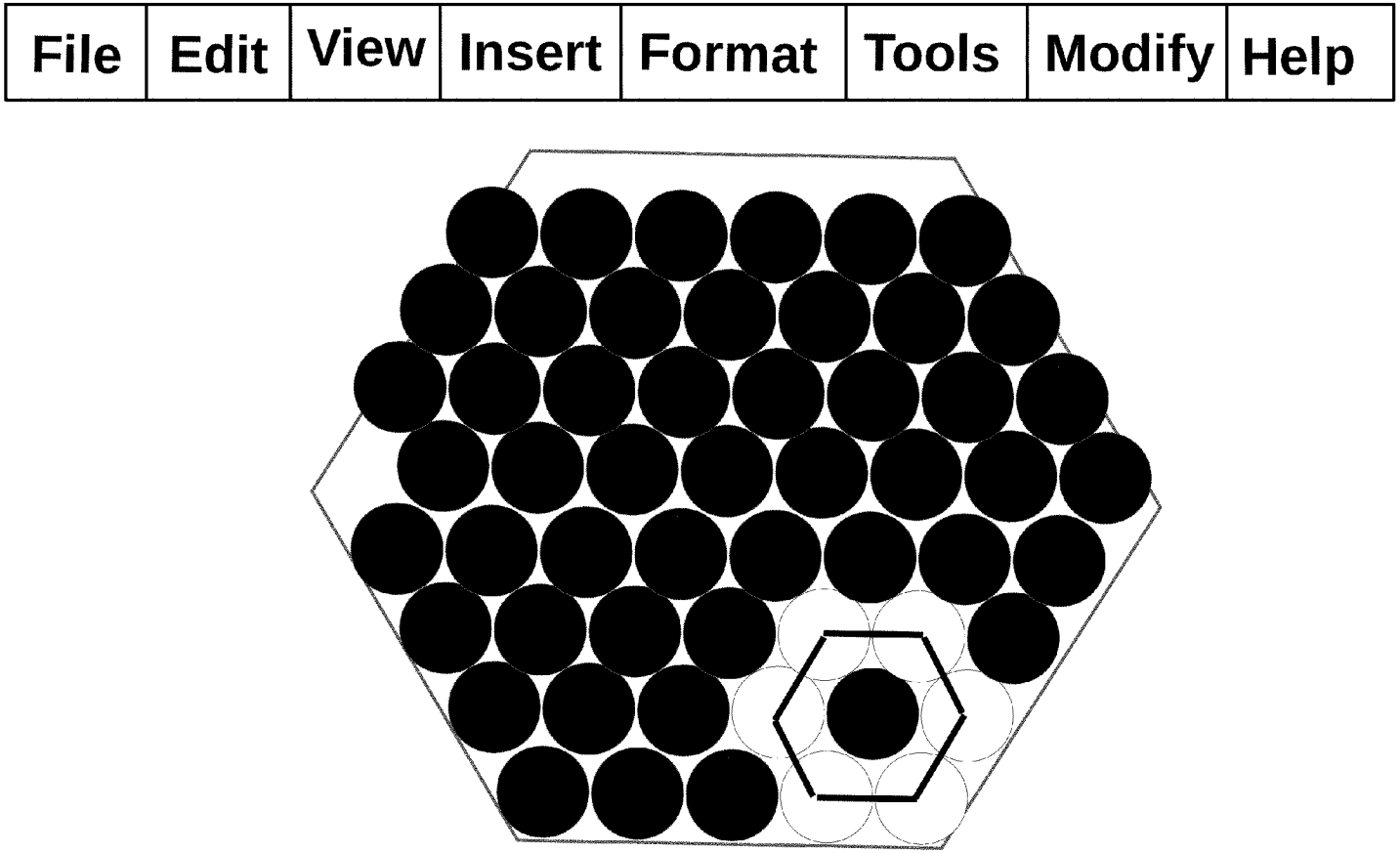

FIG. 9. A possible implementation of a GUI for controlling the image and text displayed.

Figure 10:
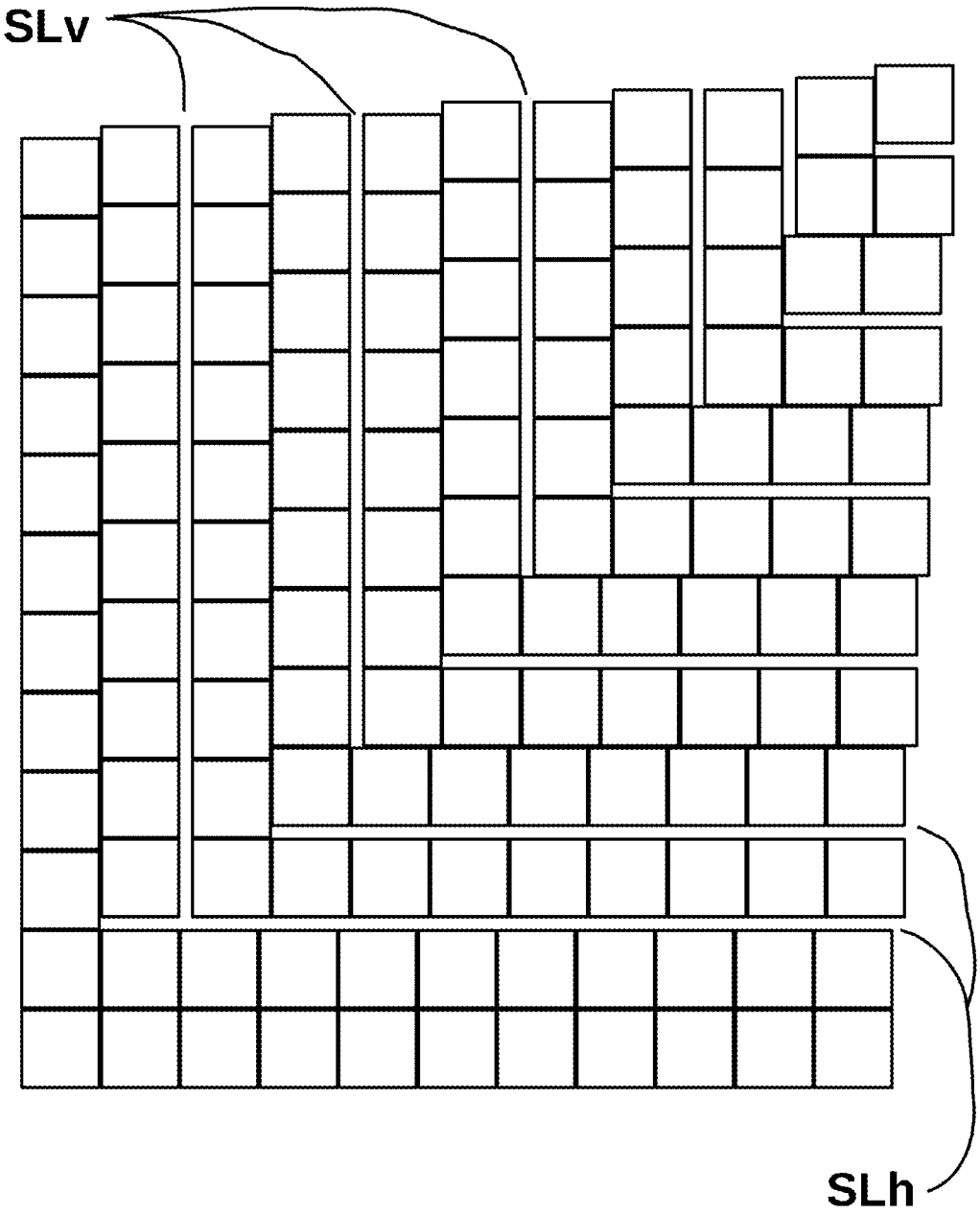

FIG. 10. A possible variation with displaced modules.

Figure 11:
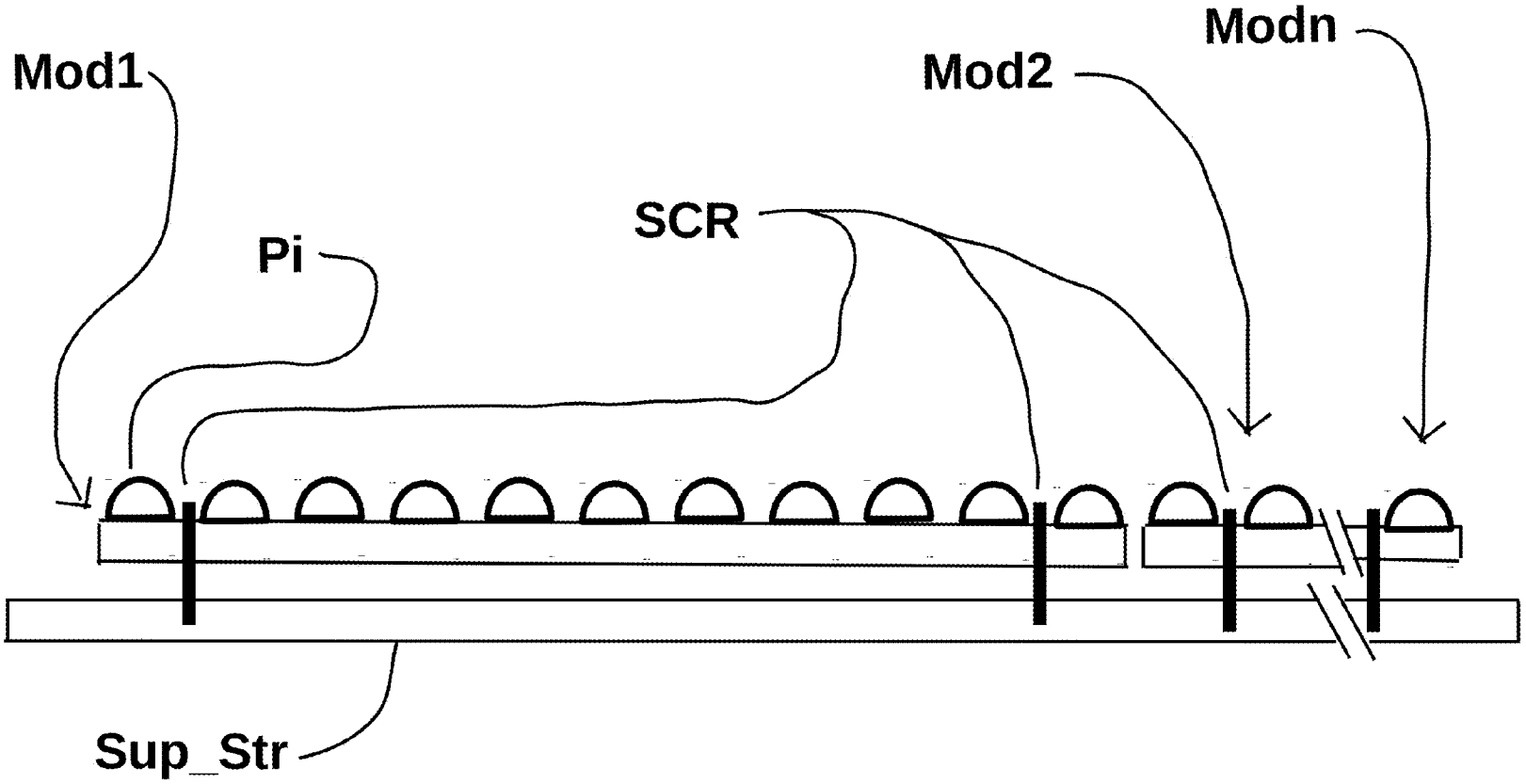

FIG. 11. A variation of the attachment of the light emitters to the supporting frame. This attachment keeps the supporting frame under the lights, allowing the lights to be closer to each other at the edges, therefore decreasing the dark edges between frames.

Figure 12:
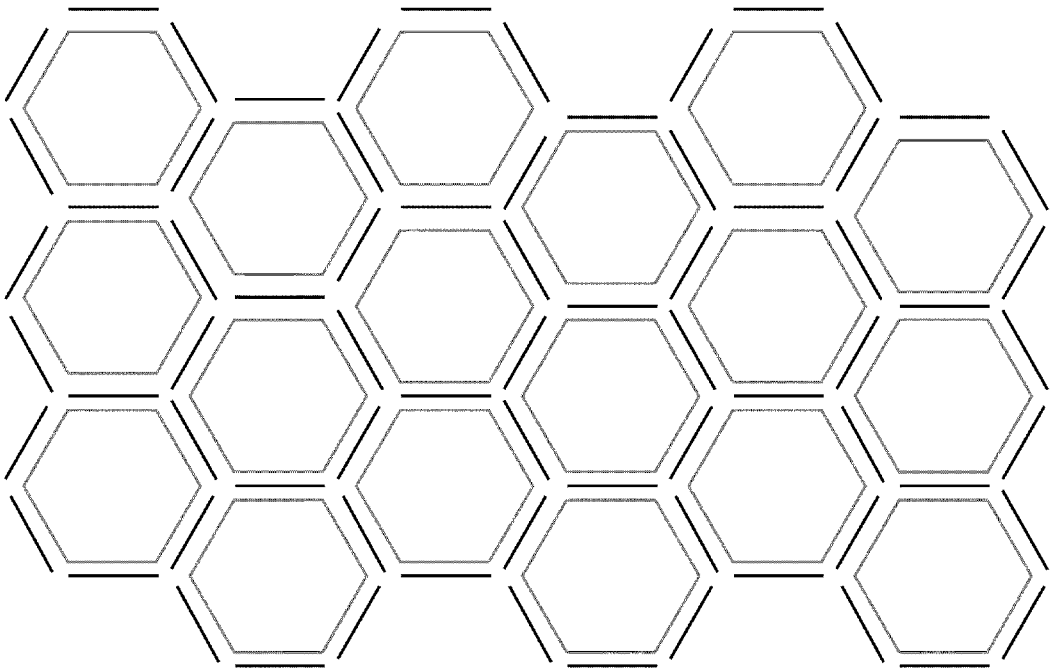

FIG. 12. A variation of the hexagonal arrangement with linear bars in between each of the hexagon sides. The linear bars in between may have the pixels either linearly arranged or in the usual triangular or square shape. With shorter linear light distribution, which is at a different direction than the other light emitters, such a linear arrangement contributes to further hinder the visual impression of light continuity across the announcing board.

Figure 13:
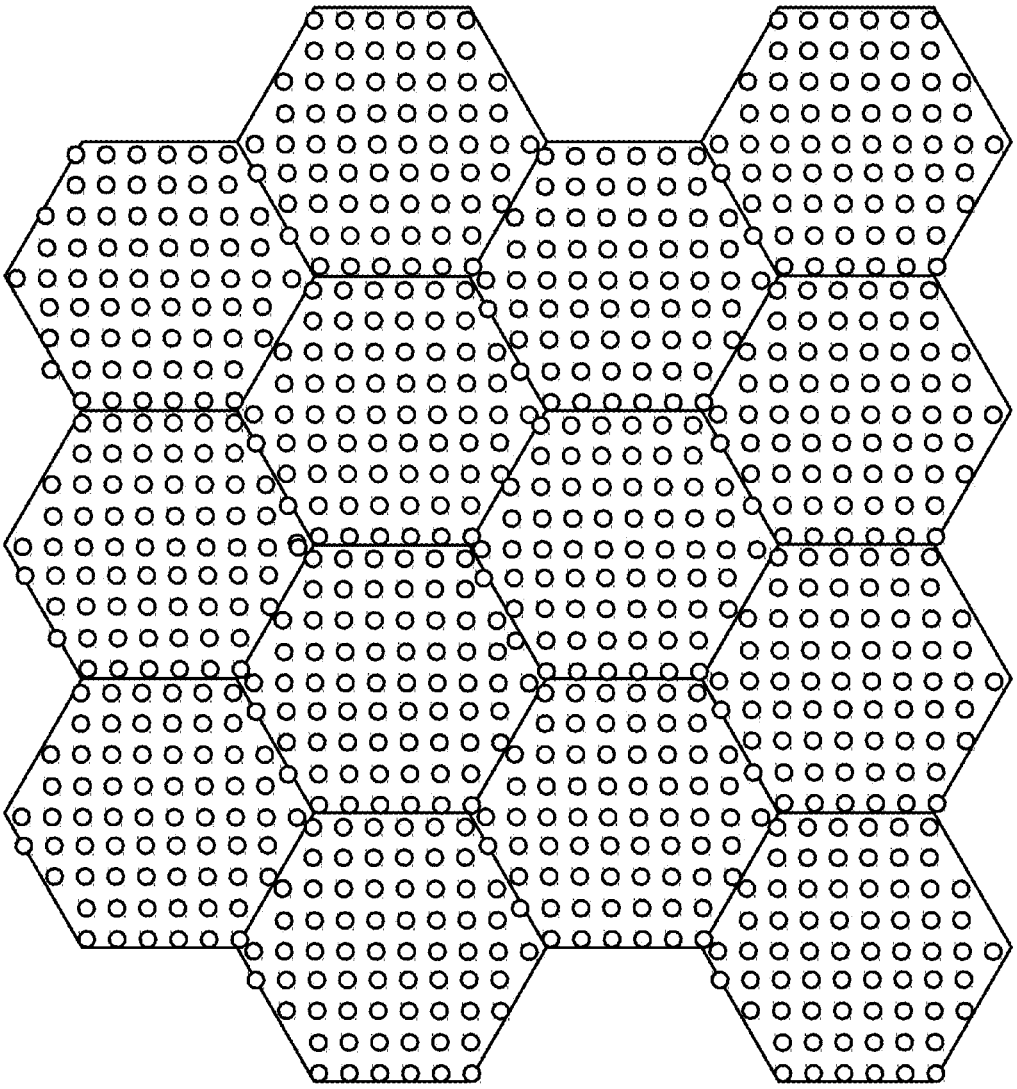

FIG. 13. A variation of the main embodiment with the light emitting pixels at the same checkerboard spatial arrangement within each hexagonal module but one which still breaks the horizontal line continuation from one module to the next due to the relative position between the hexagonal modules. Note that this arrangement does not break the vertical lines from top to bottom of the surface, vertical lines going from one hexagonal module to the ones above and below it.

Figure 14:
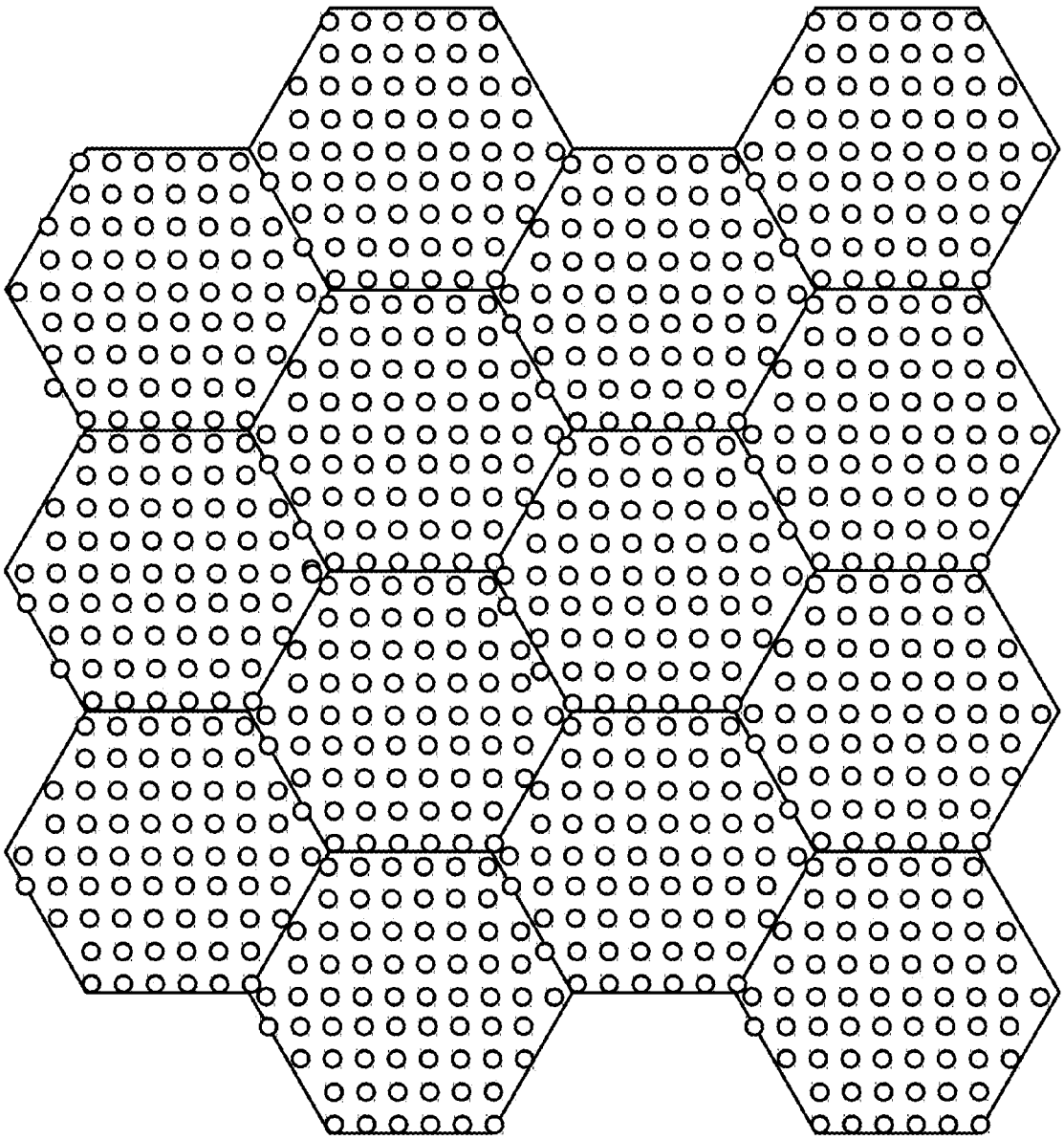

FIG. 14. A variation of the main embodiment with the light emitting pixels at the same checkerboard spatial arrangement within each hexagonal module but one which still breaks the horizontal line continuation from one module to the next due to the relative position between the hexagonal modules. Note that this arrangement also includes a horizontal displacement the is better than FIG. 13 because it also does break the vertical line continuation.

Figure 15:
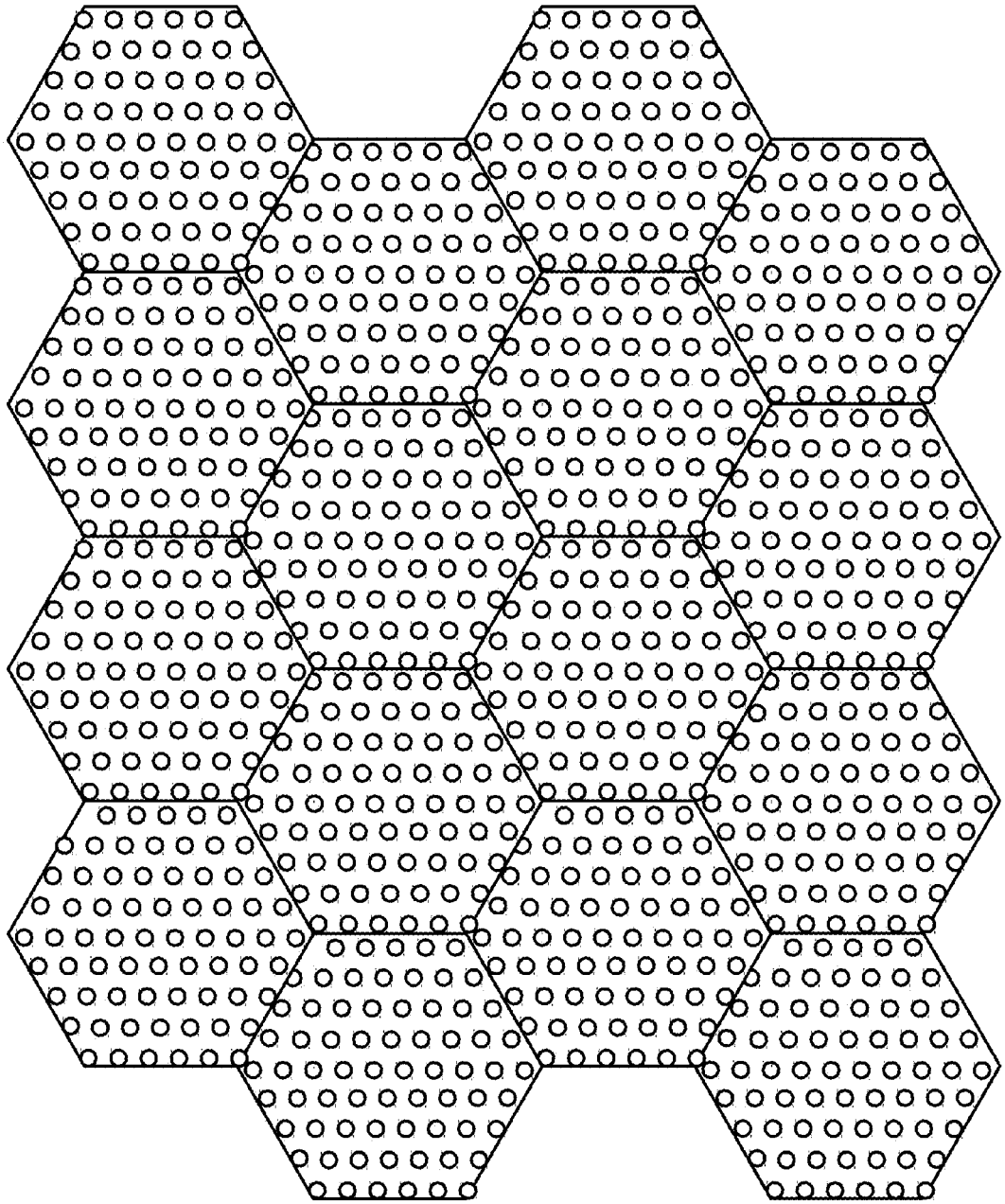

FIG. 15. A simple hexagonal module with hexagonal close packed light emitter device pixels arrangement is enough to eliminate light emitting devices to be on a continuous line from one module to the the next., due to the relative internal position of the light emitting device pixels.

Figure 16A:
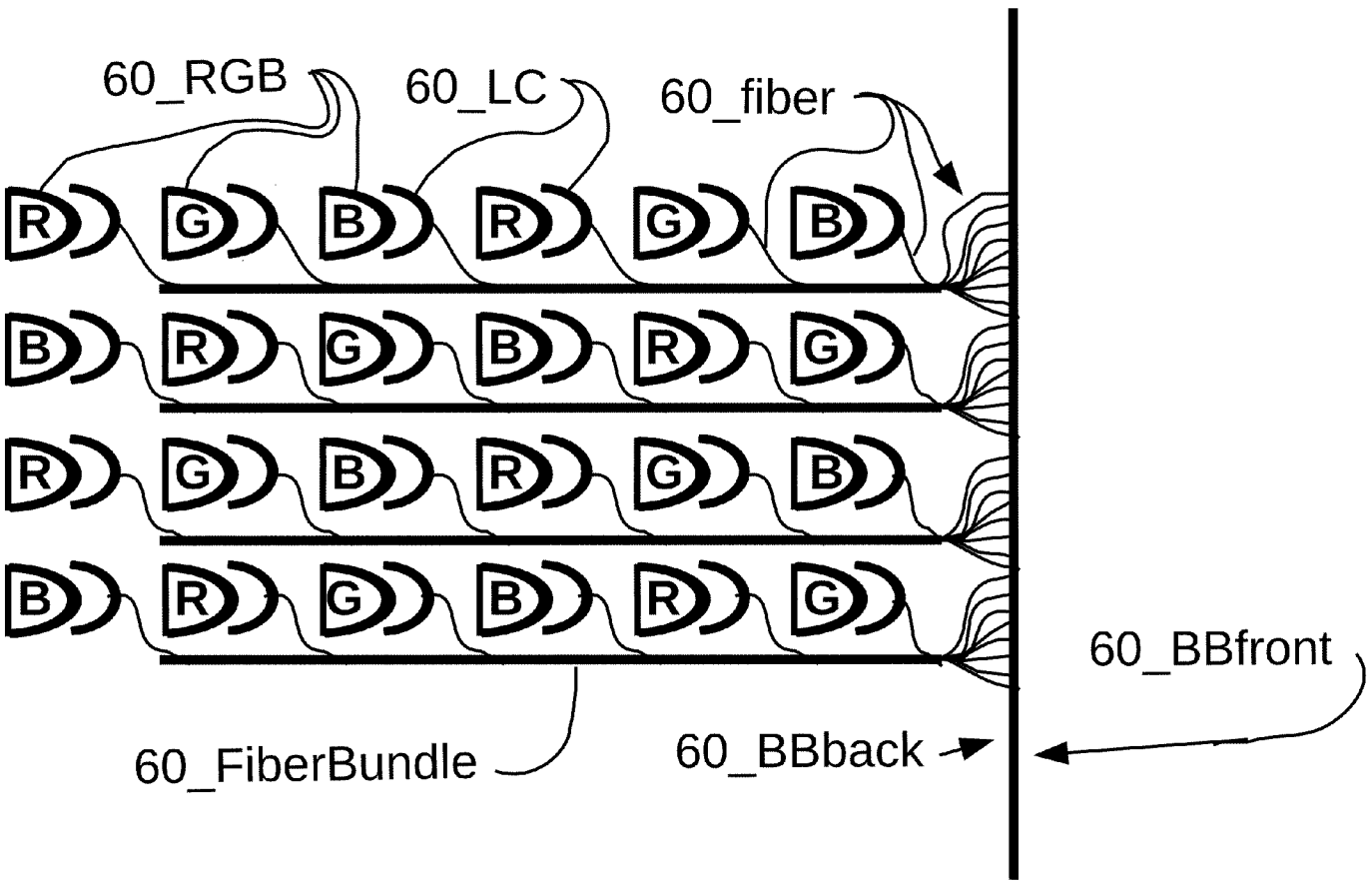

FIG. 16A—Side view of inside RGB set (60_RGB) with light catchers (60_LC) and optical fibers (60_Fiber) leading to light filler (60_LF) between modules (60_Mod). On the Billboard front side (60_BBfront) the light fillers are organized to fill in the usually small spaces between the modules that make the full billboard.

Figure 16B:
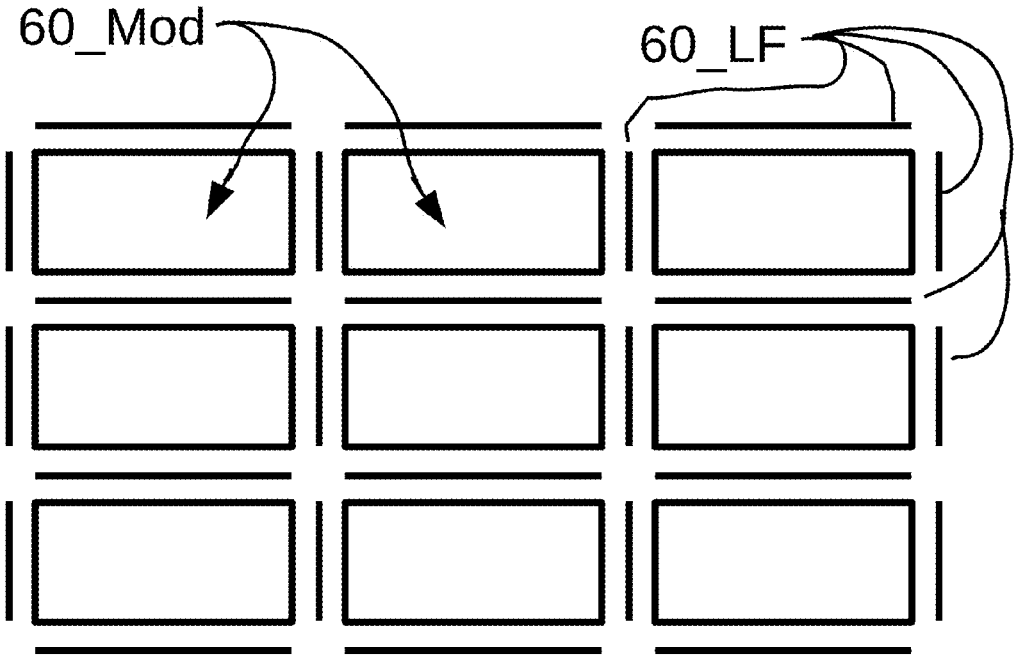

FIG. 16B—Front view of a billboard showing the light fillers (60_LF) between each module (60_Mod). Illumination for the light fillers 60_LF comes from behind the billboard piped into the light filler 60_LF with optical fibers or with LED directly positioned along the light filler 60_LF FIG. 17. Different arrangements 60_LF type 1 and 60_LF type 2 of the optical fiber endings within the space between modules 60_Mod. Note that since most optical fibers are much smaller than most LEDs, the light fillers may have one row of fiber or two or three rows or more.

Figure 18A:
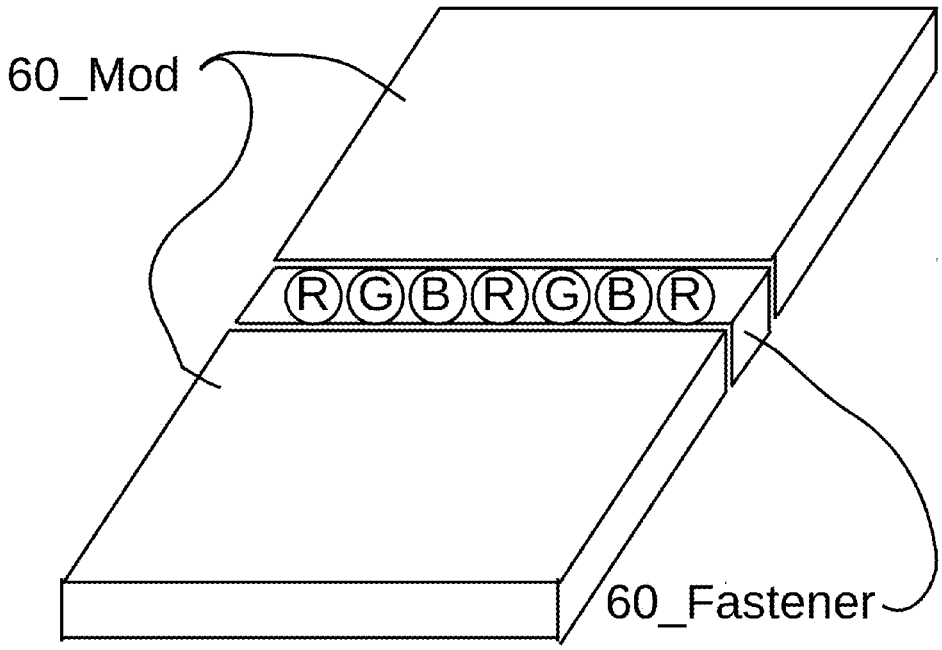

FIG. 18A—A module fastener 60_Fastener, or supporter, which exists to keep the multi-module structure together. Here the fastener 60_Fastener is sandwiched between two modules which it keeps together.

Figure 18B:
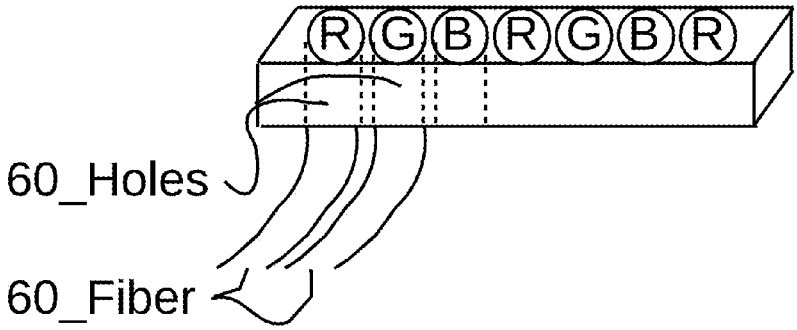

FIG. 18B—A module fastener 60_Fastener, or supporter, which exists to keep the multi-module structure together. Here the fastener 60_Fastener is isolated for better understanding, showing the details of one of the many possible adaptations for optical fibers to be used, which is to insert the optical fibers through pre drilled holes on fastener 60_Fastener, as shown.

Figure 19:
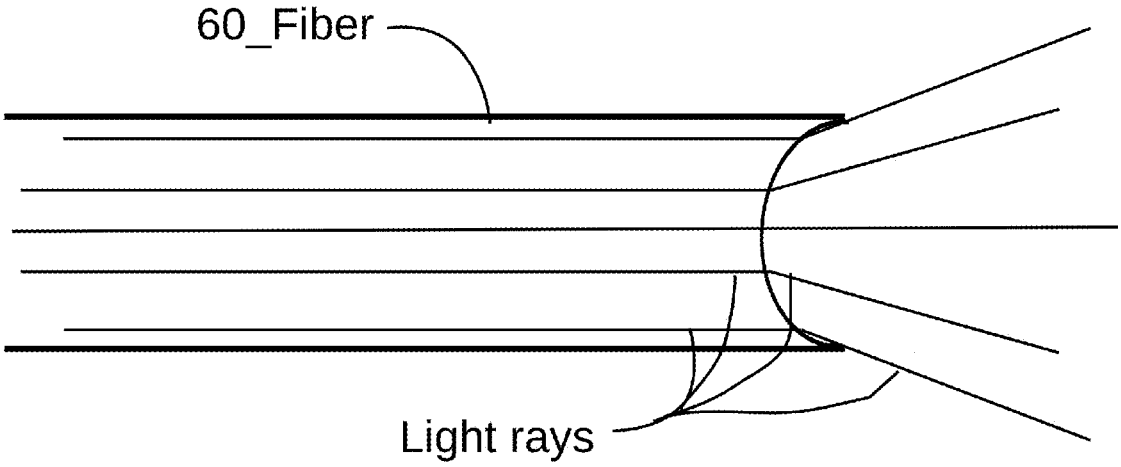

FIG. 19—The optical fiber ending at the board image side does not have to be hemispheric. Fiber ending may be a ½ sphere, a part of a sphere smaller than ½ of the sphere, or it may be any other curve of any number of linear sections. The surface of the fiber ending may also be smooth or non-smooth. In the former case (smooth surface fiber ending) the fiber ending acts as a lens, while in the latter case (non-smooth surface ending) the fiber ending acts as a diffuse scatterer at all points on the surface.

Figure 20:
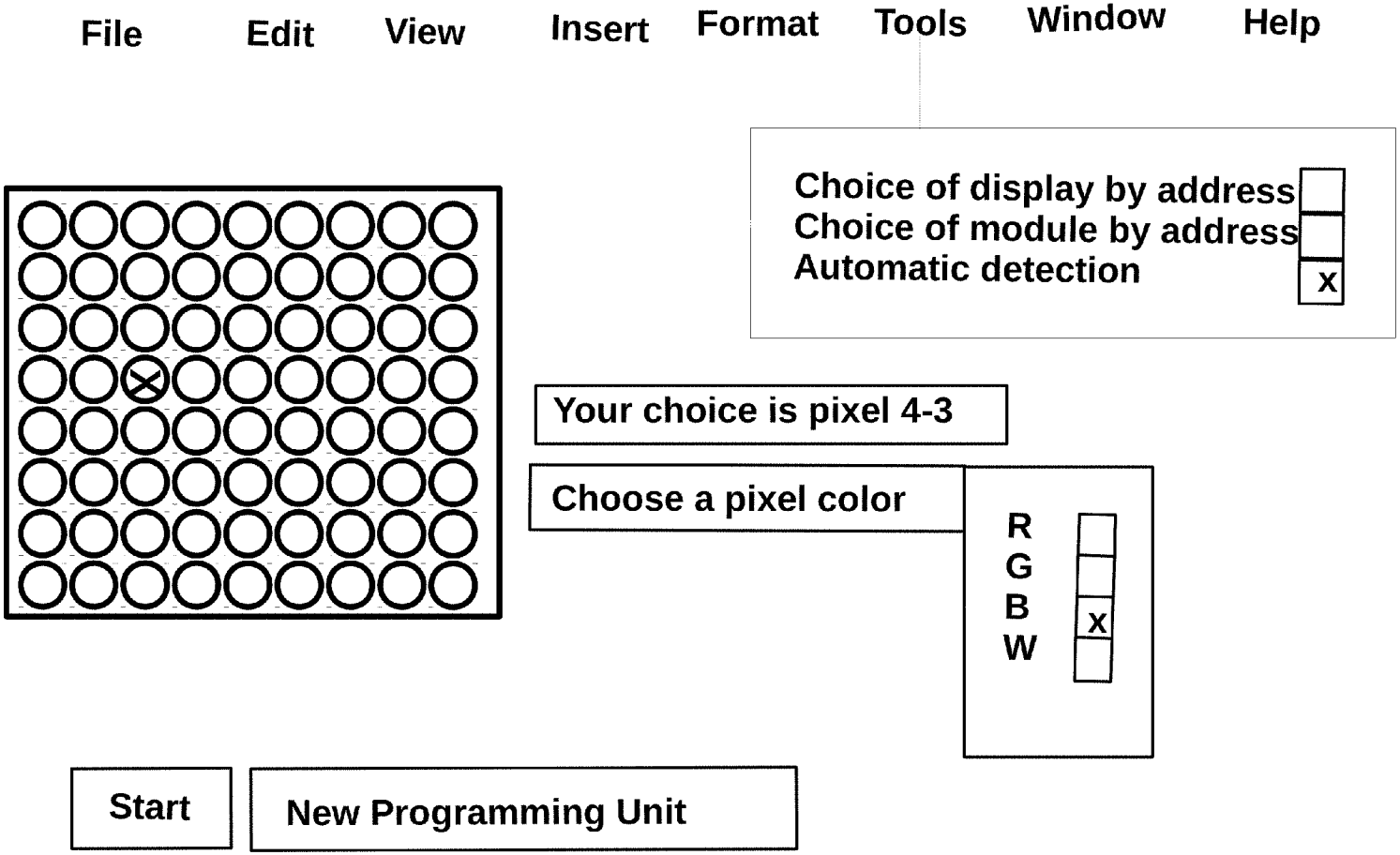

FIG. 20—A GUI used to control a typical large size display, as a billboard or a TV tiled indoor display.

DRAWINGS—LIST OF REFERENCE NUMERALS h1=Hexagonal standard supporting block with horizontally arranged pixels with each row being such that the x coordinate (horizontal) of all its pixels elements are at the average x-coordinate of either row above and below it. This arrangement is the hexagonal close-packed arrangement, which was proved by Gauss to be the pixel distribution with the largest number of pixels per unit area (Gauss proved this for circles, not for pixels, of course). A concrete example is an arrangement of oranges (or of apples) on a flat display surface; if they are arranged on an hexagonal close-packed arrangement, then it contains the maximum possible number of oranges (or of apples) per unit area. The reader will notice that this arrangement causes visual lines along the horizontal direction and along two oblique directions which are at 60 degrees and 120 degrees with the positive x-axis, using the normal angular coordinates defined for polar coordinates.

h2=Hexagonal standard supporting block with horizontally arranged pixels such that there are two alternating groups of pixels, G1 and G2, each two rows high, G1 being characterized by two rows in which all pixels are above and below each other (same x-coordinate), while G2 being characterized by the x coordinate (horizontal) of the pixels of one line being the average of the x coordinate (horizontal) of the pixels above (and/or) below it. The center row forms a group of its own. This arrangement is partly hexagonal close-packed.

h3=Hexagonal standard supporting block with horizontally arranged pixels such that there are two groups of pixels, G1 and G2, each three rows high, G1 characterized by each group formed by three rows in which all pixels are above and below each other (same x-coordinate), while G2 characterized by the x coordinate (horizontal) of the pixels of one row are the average of the x coordinate (horizontal) of the pixels belonging to the other group which are above and/or below it. The center row forms a group of its own with the row above and the row below it.

Mod1, Mod2, . . . Modn=Module-1, Module-2, . . . Module-n.

Pi=light emitting unit, or pixel. Typically it is a conglomerate of three light emitters of three different colors, as red, green and blue (RGB), but other colors are possible, including a double red, more than three colors and one extra white light emitter being the most common.

SCR=fastening screw that holds module on supporting structure.

Sup_Str=Supporting Structure. Supporting structure which holds the modules together in their fixed position, anchored on the ground or on a building.

v1=Hexagonal standard supporting block with vertically arranged pixels with each column being such that the y coordinate (vertical) of all its pixels elements are at the average y-coordinate of either column to its left and right. This is the hexagonal close-packed arrangement, similar to h1 but rotated with respect to h1 by 30 dgs (degrees). The reader will notice that this arrangement causes visual lines along the vertical direction and along two oblique directions which are at 30 degrees and 150 degrees with the positive x-axis, using the normal angular coordinates defined for polar coordinates.

v2=Variation of the hexagonal standard supporting block v1 with vertically arranged pixels such that there are two groups of pixels, G1 and G2, characterized by each group formed by two columns such that in G1 all pixels are to the left and right of each other (same y-coordinate), while in G2 the y coordinate (vertical) of the pixels of one column are the average of the y coordinate (vertical) of the pixels belonging to a column to the side of it. The center column forms a group of its own.

v3=Variation of the hexagonal standard supporting block with vertically arranged pixels such that there are two groups of pixels, G1 and G2, characterized by each group formed by three columns such that in G1 all pixels are to the left and right of each other (same y-coordinate), while in G2 the y coordinate (vertical) of the pixels of one column are the average of the y coordinate (vertical) of the pixels at the columns at the side of it. The center column forms a group with the columns to its left and to its right.

60_LF (light fillers)—light emitting pixels at the joining structure 60_Fastener that keeps the modules together.

60_Fastener=mechanical structure that fasten together the display modules (and therefore the first partial image) for a larger display surface. They also hold in fixed position at their forward surface the pixels for the second partial image, which is the remaining part of the total image displayed.

110h=continuous line between modules of the old-art arrangement (see also 110v).

110v=continuous line between modules of the old-art arrangement (see also 110h).

DETAILED DESCRIPTION

General Comments on the Invention.

Our invention is a method and a means to forestall the introduction of lines in pixelized displays, lines which are not part of the intended image. Such lines are introduced via three different mechanisms: (1) the actual linear arrangement of pixels (light elements) which make the image (see FIG. 2), (2) the Nyquist frequency folding of visual features of higher spatial frequencies into lower spatial frequencies, and (3) the generally darker lines originating from the absence of pixels (light emitting elements) at the frames which support the individual modules with which the whole light emitting surface is divided (see 110h and 110v at FIG. 1), that is, due to the surrounding supporting structure that holds in place the surfaces, or modules, with the light emitting device pixels that are part of the first partial image. Lines, or streaks, are artificially created by the orderly x-y positioning of light emitters (pixels), which can only emit light from their fixed, linear arrangements, and never any place in-between, and these lines, in turn, give origin to Nyquist folding. Moreover, one of the features of our invention also forestall the darker lines which appear at the edges of the modules which are usually part of the whole assembly of light emitting elements. According to our invention, the complete image is partly displayed by what we call first pixels, which are distributed at the surface of the modules, and are part of what we call first partial image, and partly displayed by what we call second pixels, which are distributed at the surface of the supporting structure that surrounds the modules, and are part of what we call second partial image. It is worth to note here that most often the individual light emitting device pixels are arranged on one of a possible multiplicity of geometrical arrangements, as the checkerboard distribution, modified checkerboard with different x- and y-separation, the hexagonal close-packed distribution, etc. Our invention includes the use of any of these and particularly combination of them inside each module. The use of combination of the possible regular geometric arrangements is an important feature of our invention because it contributes to breaking the lines formed by the position of the pixels from one module to the next.

Lines are artificially introduced in the image produced by a pixelized display because the light emitters (pixels) are usually arranged in lines (rows and columns), as an ordered x-y array, or checkerboard array, or chess board array, which in turn is used because this arrangement is easier to manufacture and also because it lends itself better to a control by a micro computer, micro-controller and the like. The artificially introduced perception of lines is due to the lack of light emitters outside of the checkerboard matrix-like array—only light along the lines defined by the existence of the light emitters. Given that current display technology has to resort to the use of individual light emitters (pixels), a better image can be produced if the pixels are not arranged in an ordered x-y display. As an example, Seurat, the best exponent of the painting school known as pointillism, who created paintings with dots of varying colors and sizes distributed on the canvas, did not arrange the dots in his paintings on any array or other regular distribution, but rather his dots were randomly placed, besides being of random sizes too. A comparison between a Seurat painting and a current art outdoor display will bring out one aspect of the differences between our invention and the existing art, and the reader is encouraged to spend some time observing both and thinking about the differences between them and the consequences for the visual impact on the observer. It is of note that some less expensive printing methods also use small dots to print an image in colors, a method often used by newspapers. Yet, some newspapers that do so, do make the dots of varying sizes arranged on a non-linear distribution, as Seurat did, not as orderly arranged dots as the outdoor displays do.

Preferred Embodiment: FIGS. 3*a* and 3*b*.

FIGS. 3*a* and 3*b* display the main embodiment of our invention, which is a method and a device to prevent the formation of lines in images created by small individual light emitters, and the prevention of the appearance at low frequencies of repetitive features which in the intended image appear at higher frequencies, due to Nyquist folding. It is to be noted that lines across an image gives the sensation of an unnatural and disturbing image, because the brain detection and interpretation mechanism in human eyes expects no lines. The lines usually originate from two sources: (1) the horizontal and vertical lines of light emitters in current art displays (see dots in FIG. 1), and (2) the darker lines at the frames of the modules which are used to build up the total image surface, which run from one side to the other, and from top to bottom (see 110h and 110v FIG. 1), and the appearance of features at low frequencies are a consequence of the Nyquist folding.

The main embodiment discloses a device generally similar to the existing displays as described above: a vertically oriented display designed for street announcements, typically measuring 20 meters horizontally by 5 meters vertically, which is placed in a location easily visible from most of the streets in the neighborhood, usually at the height of a second floor. The street announcer of my invention has a front or first surface, on which there is a large number of small light emitters, typically of three colors (red-green-blue, RGB), which can be computer controlled to be off or on at a substantially continuum range of light intensity, up to the maximum possible for the particular emitter. Parallel to and behind the front surface, there is a back or second surface, with appropriate fasteners to secure the announcing board to a supporting structure anchored on a building or on the ground, that is of sufficient strength to keep the structure on a vertical position, and which is also capable of supporting the power cables and other wires carrying computer controls, data and other signals to control the light emitters. The back surface is also provided with appropriately designed fasteners on which light emitting modules to be described in the sequel can be attached, the aggregate of which constitute the front or first surface. For the main embodiment, which is large, the whole lighted surface is generally made up from modular smaller units, which in the current devices are either square- or rectangular-shaped. Our invention discloses a different shape for the modules, though, hexagonal shape. Hexagonal shaped modules forestall the appearance of continuous darker lines on the images, which appear at the borders of the modules, and which, for square or rectangular shapes are continuous across the whole surface, horizontally (see 110h FIG. 1) and vertically (see 110v FIG. 1). While still present in the hexagonal modules, the frames lines do not form any continuous line along any direction within the lighted surface (see FIGS. 3*a* and 3*b*). Therefore the division of the display surface into hexagonal modules, instead of square or rectangular modules, contribute to the overall objective of preventing lines across the image surface. In the preferred embodiment, the hexagonal modules are 20 cm in side, but other sizes are acceptable, this 20 cm being mentioned as an exemplary possibility which is not intended to restrict the invention, which works with any module size.

Since this is an important point we repeat it: contrary to the current devices, which builds the light emitting surface with rectangular modules, our invention discloses a new shape for the module: hexagonal modules. An hexagonal module forestalls the continuing darker line created by the module frames, which is quite pronounced in current art when the field is an even illumination and color across a large surface. Comparison between FIGS. 1 with 3*a*, 3*b* and 4 shows that the edges between the modules of our invention do not continue across the whole width or the whole height of the display, while the edges between the modules do continue across the display made with current art modules of square or rectangular shape. So, one of the objectives of hexagonally shaped modules is to break the continuous lines created by existing art of displays at the junction of each module. It is worth to note that hexagons are one of the few regular 2-D (two dimensional) figures that completely fill a larger 2-D area with no empty spaces in between them, as squares and rectangles do too, but circles and pentagons do not (just try to fill a surface with circles or with regular pentagons!). On the other hand, there exists an infinite number of irregularly shaped polygons that completely fill a 2-D surface, and so, any of these irregular polygons that completely fill a 2-D surface could be a module for this invention.

Before continuing with the description of the main embodiment, it is worth to bring to the attention of the reader that cost considerations dictate that the displays should be made with modular subunits, and moreover, that within each module, the pixels should be arranged on some regular arrangement. Irregular arrangements of the pixels within each module are also possible and covered by our invention disclosure, but they suffer from creating a larger burden to the controlling electronics and to the necessary programming to control the display, and are likely to be avoided in actual displays. Moreover, it is worth to observe FIGS. 4 and 5, which displays a hypothetical arrangement of pixels which are of the checkerboard type, which has been arranged in such a way that outside the displayed hexagon the pixels (as open dots) are exactly halfway along the line of the pixels inside the hexagon (as black dots). This FIG. 4 is another method for the reader to visualize the objective of the method and means of the invention: to break the lines created by the pixels.

As a preparation for the disclosure of the invention the reader is invited to look at FIG. 6. FIG. 6 displays the pixel arrangement which we call checkerboard or x-y arrangement. Most of the displays in use use this checkerboard pixel arrangement. The checkerboard pixel arrangement should then be compared with the hexagonal-close-packed arrangement shown in FIG. 7. This is the arrangement which packs the largest number of circles on any given area. Most displays in current use do not use this arrangement, though it offers some advantages over the checkerboard arrangement. The difference between the checkerboard arrangement and the hexagonal-close-packed arrangement is also shown in FIGS. 8*a* and 8*b*, which repeat FIGS. 6 and 7 without the hexagon, to enhance the arrangement per se. Our invention discloses a combination of these two pixel arrangements, so the reader is invited to keep them in mind.

Observing FIG. 3 it is seen that the hexagonal modules already cause an improvement on the image display, because, unlike the regularly arranged rectangles or squares of current art (see FIG. 1), the edges of the hexagonal modules do not create a continuous line across the image as the square or rectangular modules of current art do; all modular sub-units necessarily have edges, but the edges of the hexagonally shaped modules do not continue along the same line from one module to the next. Furthermore, my invention discloses a second level of improvement, an improvement inside each module, to further hinder the formation of continuous lines of light, this time along the pixels, and not along the frame edges. My invention discloses 6 (six) different types of light emitter arrangements, shown as h1, h2, h3, v1, v2 and v3 in FIG. 3. Note that the difference between these six proposed internal pixel arrangements within each hexagonal module is subtle, all of them based on the same characteristic of slightly modifying the distance along some direction of a particular line of pixels. These modules are organized in such a way as to further prevent continuation of linear arrangements of light pixels from one module to the next, because adjoining modules have LEDs internally arranged in a different pattern. At the same time, these six arrangements are so designed as to lend themselves easily to assembly-line manufacturing, or even semi-automated or totally automated production, so that the cost of implementation is similar to, if not the same as, the cost of the existing devices. Yet, because of the differences between the internal special arrangement of light emitters within each hexagonal module, the internal linear arrangement which is still present in the modules disclosed by my invention does not continue into the neighboring modules. In other words, the smaller linear arrangements of pixels in the modules of my invention are small enough to cause only such a minimally long line as to be undetected or, at most, to cause less visual discomfort on the viewer when compared with the current art pixel arrangement. In other words, there are still small lines of pixels within each module of my invention, but these lines do not continue from one module to the next, which results in that with this arrangement of light displays there exists only very small continuous line segments, which are often interrupted, precluding the visual disturbing effect of lines along the lighted image. This is true for both the darker frames surrounding the modules and for the pixel arrangement as well.

Moreover, the hexagonal modules can be made arbitrarily small, which in turn causes that the small linear segments inside them are accordingly smaller too. Of course that a compromise must be reached with the module size, because smaller modules cause an increase in the cost of erecting them.

For better effect, more than six different light arrangements within each module can be created, with the further breaking of continuous lines from one module to the next one. As visual observation of FIG. 3 shows, there are almost no continuous lines running along any direction. Moreover, each of the six arrangements disclosed in our invention may be in any one of the three possible rotations of each module: original, 60 degrees and 120 degrees. The reader will notice that the other three possible rotations, of 180 degrees, 240 degrees and 360 degrees repeat the original configuration or the first two rotations, only three different angular placements being possible.

Each hexagonal module disclosed by my invention should function as a unit, with a standard wire harness to receive power from an appropriate power supply, and computer control from the external computer, which controls the image on the whole display, or first surface. In the main embodiment of our invention, the control of the light emitting elements within each hexagonal module is partly made by control electronics that is included in each module, which includes an 8051 microcontroller. Other microcontrollers are possible, as the PIC 12C508A, the PIC 18F8720 microcontrollers, or the TMS320C2000 digital signal processor, to name just a few. This division of tasks with the main external microcomputer, which receives the full image in software and is responsible, using appropriate software, to control the whole display, is one of the options, not a restriction on our invention, which may also be implemented with one single controlling unit in control of all pixels on the whole display surface.

Observing FIG. 3 the reader will notice that at the outer edges of the display there are holes which cannot be filled-in by hexagons. Our invention also discloses parallelograms which are half-hexagons, to fill-in the ends of the arrangement of hexagonal modules. These shown at the top and right of FIG. 3*a*. Alternatively, the fill-in partial hexagons may be manufactured as part of a variation of the hexagonal modules.

EXAMPLES OF INTENDED USE

The main or most important intended use of the invention is the outdoor display of art, particularly the display of murals, that have been created already for outdoor public display for the benefit of the 99 percenters, as the Mexican murals are. The inventors believe that the improved quality of the display image provided by this invention would make billboards using the invention admirably suited for reproductions of the Diego Rivera's murals.

Another intended use of the invention is the outdoor display used mostly for commercial advertisements with its lower edge usually at a height of a $2^{nd}$ or $3^{rd}$ floor, total typical height from one floor (3 m=9 ft) to 2 floors (6 m=18 ft.).

Another intended use of the display disclosed in my invention is the large outdoor displays used in some sports stadiums and arenas, some of which being 12 m high (35 ft) as in large soccer, football or baseball open arenas.

Another intended use of the display disclosed in my invention is for passengers information on arrivals and departures boards in train stations and airports.

Another intended use of the display disclosed in my invention is for convention halls.

Another intended use of the display disclosed in my invention is for the slide displays that are often used to guide a speaker during a conference, where the speaker projects a power-point presentation. This application would require a much smaller illuminated area, typically 7 to 10 feet horizontal by 4 to 6 feet high.

Another intended use of the display disclosed in my invention is for computer monitors and home TVs.

Operation of the Invention

A micro-computer is normally required to operate my invention, though it can be implemented with hardware logic too, particularly if the displayed image is fixed or changes within a small set of patterns, as a bus display, which continuously displays the bus number and a fixed number of stop stations, date and time of the day. The main embodiment uses distributed computing, a technical term which means that not all computing is performed at the controlling microcomputer, but rather that this controlling microcomputer sends general information regarding the image to be displayed to other less powerful microcomputers, called microcontrollers, in this case associated with each of the hexagonal modules, one microcontroller for each hexagonal light module, which then take care of the details of the light emitted by each pixel in its control. This division of control is not necessary for the invention, which can also work with the microcomputer in total control of all the pixels or with microcontrollers controlling more than one light module.

The main embodiment of our invention makes use of a binary addressing system to select which pixels are on and a binary number to control at which brightness each pixel is set. The main embodiment also uses local microcontrollers associated with each module to control the pixels in them, according to instructions originating from a microcomputer which is in charge of the whole display and which continuously updates each microcontroller according to a preloaded program. The wires and cables carrying the digital information from the microcomputer to the microcontrollers and the power wires and cables that carry the power to each light emitting element, as an LED, pass at the back surface of the display then to each module, as required. Other possibilities are acceptable, as the microcomputer directly controlling each pixel, or other path for the cables, which can run inside the supporting structure instead of behind it, of on the sides of it, etc., all such variations being acceptable without changing the nature of our invention.

Each pixel (that is, each first pixel at the modules, forming the first partial image, and each second pixel at the supporting structure, forming the second partial image) is then selected to emit at a particular time varying intensity, in such a way that the aggregate of the light emitted by them forms an image or letters, or both, as required for a total image possibly including letters.

The main embodiment of the invention make use of a computer or similar device, with which a desired figure or drawing, or text, or geometrical shape, etc. may be transferred to the electronic controlling system for display on the device. The computer may, in turn, be controlled via a Graphical Use Interface similar to the interfaces used in ordinary computer systems, with drop-down modules for "file", "edit", etc., particularly designed for the device. FIGS. 9 and 20 are examples of such an interface.

Description and Operation of Alternative Embodiments

An alternative embodiment uses the same LED arrangements in the modules forming the first partial image as the main embodiment does, that is, hexagonally-close-packed arrangement, pseudo hexagonally-close-packed arrangement, checkerboard arrangement, etc., but also has LEDs or other light emitting elements forming the second partial image on the smaller, usually linear spaces occupied by the supporting structure that holds the modules together, and keeps the same square or rectangular frame as prior art. This alternative embodiment is a smaller modification on current art when compared with the main embodiment. This alternative embodiment may be chosen for compatibility with existing displays.

Another alternative embodiment uses hexagonal modules instead of rectangular modules, but the same checker-board light emitting elements as prior displays. This alternative embodiment forestalls the line continuation from one module to the next along one direction but allows line continuation on a direction perpendicular to the direction along which the lines are frustrated. This happens because of the arrangement of the hexagonal modules displace the internal lines along the direction which is parallel to the hexagon sides but does not displace the internal lines along the direction which is perpendicular to the hexagon sides. Given the continuation of line of pixels from side-to-side, or from top-to-bottom is the main offensive characteristic, such an alternative embodiment would offer partial improvement, along one direction only, but it would still be an improvement over current devices ("current art" as the lawyers like to say).

An alternative embodiment uses light emitting elements at fixed random positioning on each module. This embodiment maximizes the break of line arrangement on the displaying surface.

An alternative embodiment uses light emitting elements at fixed regular positions with a random variation added to each fixed regular position, on each module. This embodiment maximizes the break of line arrangement on the displaying surface.

Another alternative embodiment of our invention is the implementation of the local displacement of small segment of light emitting elements distributed on the LCD monitors used with computers or with TV screens. In this case the total surface is not divided in modules, but it is monolithically manufactured as a single unit, so this alternative embodiment makes use of one part only of the method and means disclosed for the outdoor and indoor displays disclosed in the main embodiment, it is to be noted that current LCD monitor displays are made with such small pixels that they hardly cause any disturbing sensation on the viewer, but still a small improvement can be made on the image, or else the pixels can be made larger (thereby decreasing the production cost) offering still an acceptable image if the larger pixels are distributed as disclosed in this invention, frustrating the line continuation across the screen.

Another alternative embodiment of our invention is to organize the modules as either squares or rectangles and having the pixels inside each module organized in a checkerboard arrangement, as they are in current displays, therefore maintaining the existing manufacturing line of production and adding no extra cost to them, but displacing adjacent columns and adjacent rows across the display by some fixed amount, which is a fraction of the distance between pixels. Such an arrangement would forestall that any line or column continue along the lines and columns of the adjacent modules to the sides or up and down. The fixed fraction that measures the horizontal and vertical displacements of the modules may vary from one column to the next and from one row to the next, further scrambling the line continuation. Such arrangement may be complemented with linear light arrangements that would fill-in the voids SLv and SLh as seem in FIG. 10. Many other variations are possible on such horizontal and vertical displacements, still maintaining the principle of breaking any long line or column along all directions.

For the use of the technology disclosed in this invention it is not necessary that the display is organized in modules, it being possible and within the scope of the invention that the full display area is made in a unit. This is actually always the case for small displays, as in the stripe-like displays on some buses, on displays indicating directions on buildings visited by newcomers, as in museums, government buildings, on some advertisements on window displays, and more. The size of the displays form a continuum, and even if the larger displays are easier to manufacture with modules they work perfectly well when constructed as a single unit.

CONCLUSION, RAMIFICATIONS, AND SCOPE OF INVENTION

There are many possible variations of the main embodiment or of the alternative embodiments, which are intended to be covered by this invention. For example, Four of the six hexagonal modules disclosed in the main embodiment can be positioned in three rotational possible orientations, each of which has different characteristics: the main orientation, rotated 60 dgs counterclockwise and rotated 120 dgs counterclockwise. The next rotation, 180 dgs counterclockwise repeats the original one, etc., so there are only three distinguishable rotations. Each of these rotations applied to h2, h3, v2 and v3, produce another pixel arrangement with respect to the main supporting structure which is different than the disclosed in FIG. 3, increasing the possible variation of elementary hexagons from 6 (as in FIGS. 3*a*: h1, h2, h3, v1, v2 and v3) to 14 (h1, h2, h2-rot60, h2-rot120, h3, h3-rot60, h3-rot120, v1, v2, v2-rot60, v2-rot120, v3, v3-rot60, v3-rot120), where the name extensions are self-explanatory. Note that h1 and v1 do not produce new light emitter arrangements when rotated by 60 dgs and 120 dgs because they have a 60 dgs rotational symmetry.

The light emitters may be laser diodes.

The light emitters may have its beam reflected by a mirror with controllable motion, under the command of a microcomputer or of a microcontroller, which is programmed in such a way as to point the light to the proximal extremity of a fiber optical bundle, the distal extremity of which are perpendicular to the first surface described above, on which images are created.

The light emitters may have its beam reflected by a mirror with controllable motion, under the command of a microcomputer or of a microcontroller, which is programmed in such a way as to point the light to the proximal extremity of each optical fiber of an optical fiber bundle, the distal extremity of which are perpendicular to the first surface of 110h and 110v described above, which is part of the complete image.

The light emitters within each module may be organized in an arrangement which is the same as all others, but horizontally and/or vertically displaced by a fraction of the distance between each pixel. For example, the lower row may be ⅓ of the pixel separation lower with respect to the supporting module frame than the average, causing that all other pixels, at a fixed distance from it, are also lower by the same amount. This would preclude that a next neighbor module, to the left or to the right, would create a continuous line. Instead of ⅓ the displacement can be ¼, ⅜, or some other fraction. The same principle applies to the most left column, displaced ⅕ or any other reasonable fraction to the right, causing that all other pixels are so displaced with respect to the average displacement, again disrupting the existence of vertical lines across the whole surface.

The main embodiment uses LEDs as light emitters, which is not a restriction of my invention, other types of light emitters being possible without changing the invention, including optical fibers for outdoor and indoor displays, including projectors, or for personal computer monitors and TVs. The main embodiment uses light emitters in the colors red, green and blue (RGB), with which all colors are created as an appropriate mixture of these colors. Other combinations used in current art and possible for our invention are 2R-1G-1B (two reds, one green, one blue), or RYGB (red-yellow-green-blue) or RGB and one white, to mention just a few that are in current use, other combinations being possible as know to persons with skills or knowledge in the field of image displays. The controlling computer has also command and control of the appropriate hardware to control the current passing through each LED, which in turn determines their brightness. The main embodiment discloses hexagonal blocks with sides equal to 20 cm, which are populated by the LEDs. The hexagonal modules are constructed with appropriate hardware to fasten them to the supporting structure behind it, and to receive the wires for electric power and other controlling electronics, which are standard. The hexagons fill in all the display space on the display board.

The main embodiment of my invention discloses modules of an appropriate shape and size, which, for the main embodiment are hexagons with sides equal to 20 cm. The main embodiment discloses six types of hexagons, which differs from each other by the distribution of the arrangement of the light emitters inside in each. There are other variations on the distribution of light emitting modules inside each module which are possible including totally random positions.

The main embodiment of my invention uses hexagonally shaped standard blocks which are populated with a plurality of individually controlled light emitters. These hexagonally shaped standard blocks can be arranged next to each other, supported by an appropriate structure behind them. The light emitters are arranged inside the standard hexagons in one of a plurality of pre-determined arrangements, which, in the main embodiment, consist of six pre-determined arrangements, as shown in FIGS. 3*a* and 3*b*. The hexagonal block arrangement is chosen because the hexagon is one of the 2-D figures that can completely fill in the 2-D space. Inside each hexagonally shaped standard blocks, the light pixels are organized in one of six possible arrangements as shown in FIGS. 3*a* and 3*b*. These six arrangements were chosen with the view of facilitating the control of which ones are turned on and at which brightness. For this purpose of facilitating control, the individual light pixels are organized in either an overall vertical arrangement or an overall horizontal arrangement. There are three types of generally vertical arrangements disclosed for the main embodiment, which are labeled as type v1, type v2 and type v3, and three types of generally horizontal arrangements which are labeled as type h1, type h2 and type h3. Other variations of v1 and h1 are possible, all within the scope of our invention.

FIGS. 3*a* and 3*b* display six regular, simple arrangements that lend to easy regular labeling and control by a microcomputer, yet they partly break the monotonous grid pattern characterized by the x-y arrangements used by prior art. In reality, the disclosed light emitting pixel arrangement is virtually as spatially organized as current light displays are, while going a long way to break the human perception of unnatural spatial organization, which disturbs human observers of the display. Each of the six pixel arrangements used and shown in FIGS. 3 show either a horizontal or a vertical type of order, which is peculiar to each and different that the other five types. It follows from the differences in pixel distribution within each hexagonal module that the lines characteristic of each of these six distributions are different that the lines of the others, and consequently the small lines characteristic of each hexagonal module do not continue into its neighbors. When the six hexagonal standard blocks are used to fill a 2-D surface it is possible to have a line of pixels that continues from one of the modular hexagons to the next, but it is extremely unlikely that if the hexagons are placed at random any line of light emitters would continue from one side to the other of the display. Our invention does not require a careful arrangement of the modules around each other, it being only necessarily that statistically the probability of line continuations along several adjoining modules is small.

The six types of pixel organization inside each regular hexagonal pixel block is different from the others. All hexagonal blocks are of the same size, so they are capable of filling a 2-D (two dimensional) surface. This is a generally known property of the hexagons, which is one of the few regular 2-D figures that can fill all 2-D space. The differences between the six hexagons is the LED distribution over their surfaces. Close attention to the dot pattern over their surface will discern three types of hexagons with vertically arranged arrays (type v1, type v2 and type v3), and three types of hexagons with horizontally arranged arrays (type h1, type h2 and type h3), see FIGS. 3*a* and 3*b*. Each of these either belong to a group 1, which have each element of any row (or column) positioned halfway between each element of the adjacent row (or column), repeating over the surface, or else belong to a group 2, which have two rows (or columns) displaced perpendicularly, separated by a row (or column) with each element positioned halfway between each element of the adjacent row (or column). In this main embodiment there is a distribution pattern among these four hexagon types, but a commercial case could have the four types randomly arranged, for cost considerations. Either case would break any continuous line along any direction, as observation of the dots, which represent light pixels (as LEDs, etc.) will convince the reader.

The pixels in each of the three types of regular hexagonal pixel blocks is arranged in a different line: horizontal, along 60 dgs with the horizontal and along 120 dgs with the horizontal. The next on this sequence would be horizontal backwards, which is also horizontal, then 240 dgs with the horizontal, which is the same as 60 dgs (backwards to it), then 300 dgs with the horizontal, which is the same as 120 dgs.

FIG. 11 displays a variation which may be added to the modules, in which the fastening screws required to keep the modules in a fixed position with reference to the supporting structure are positioned inside the modules themselves, allowing the light emitting elements to extend all the way to the border of the modules. This variation forestall the darker line between the modules which characterize the modules used by current displays.

FIG. 12 displays another variation which use a line of light emitting elements in between each hexagonal module. This extra feature adds another light distribution between the modules, which contributes to break the lines created by the light emitting elements inside each module. This line of light emitting elements shown in FIG. 12 may be a plurality of RGB pixels that are capable of displaying the second partial image, and the line of light emitting elements may then be fastened on top of the supporting structure, which is a way of separating the mechanical supporting structure from the light emitting elements.

The light emitting elements in between each hexagonal module shown at FIG. 12 is not a feature limited to the hexagonal modules, but can be used for the more common rectangular modules or any other shaped module. This is so because the objective of using the light emitting elements in between each hexagonal module, which we call "light fillers" (60_LF), is both to introduce a variation on the regular pixel positioning to prevent lines on the display, but also to prevent darker areas around the modules, darker areas which are present in most of the existing billboards. We also refer to these light emitting elements in between each module as second plurality of light emitting device pixels, to differentiate them from the first plurality of light emitting device pixels, which are the light emitting devices located on the surface of the modules. The inventive step is to include light emitting elements in the supporting frame around the modules, which in prior art supported no light emitters. In other words, prior art caused a darker area around and surrounding the modules. These light emitting elements of this second plurality of light emitting device pixels may be the end of optical fibers, because they occupy less space, therefore having less impact on the structural integrity of the supporting structure. Of they may be actual LEDs or other light emitting devices. Amazingly enough, even indoors large displays used, e.g., in conference spaces, are most often composed of tiled large flat panel TV-type screens with a clearly visible, tic-tac-toe looking, usually black frame around each individual flat screen panel. These clear black lines are visually even more offensive then the subtler darker lines at the street billboards, and the inventor cannot understand how this came to be so. This case of indoors large displays with black lines criss-crossing the display surface is used in high-end, very expensive displays mounted on some large foyers in modern, so-called up-scale rooms, intended as a socialization space that congregate a number of one-percenter shammers, as in high-tech conference spaces. The inventor suspects that even in the places frequented by the true one-percenters these mosaic tic-tac-toed LCD exist too, but the inventor has never entered any one-percenter space, so the inventor does not know if they are subjected to the same lines as everybody else does. Our invention is intended to do away with these lines between the modules in all types of large displays.

Figure 17:
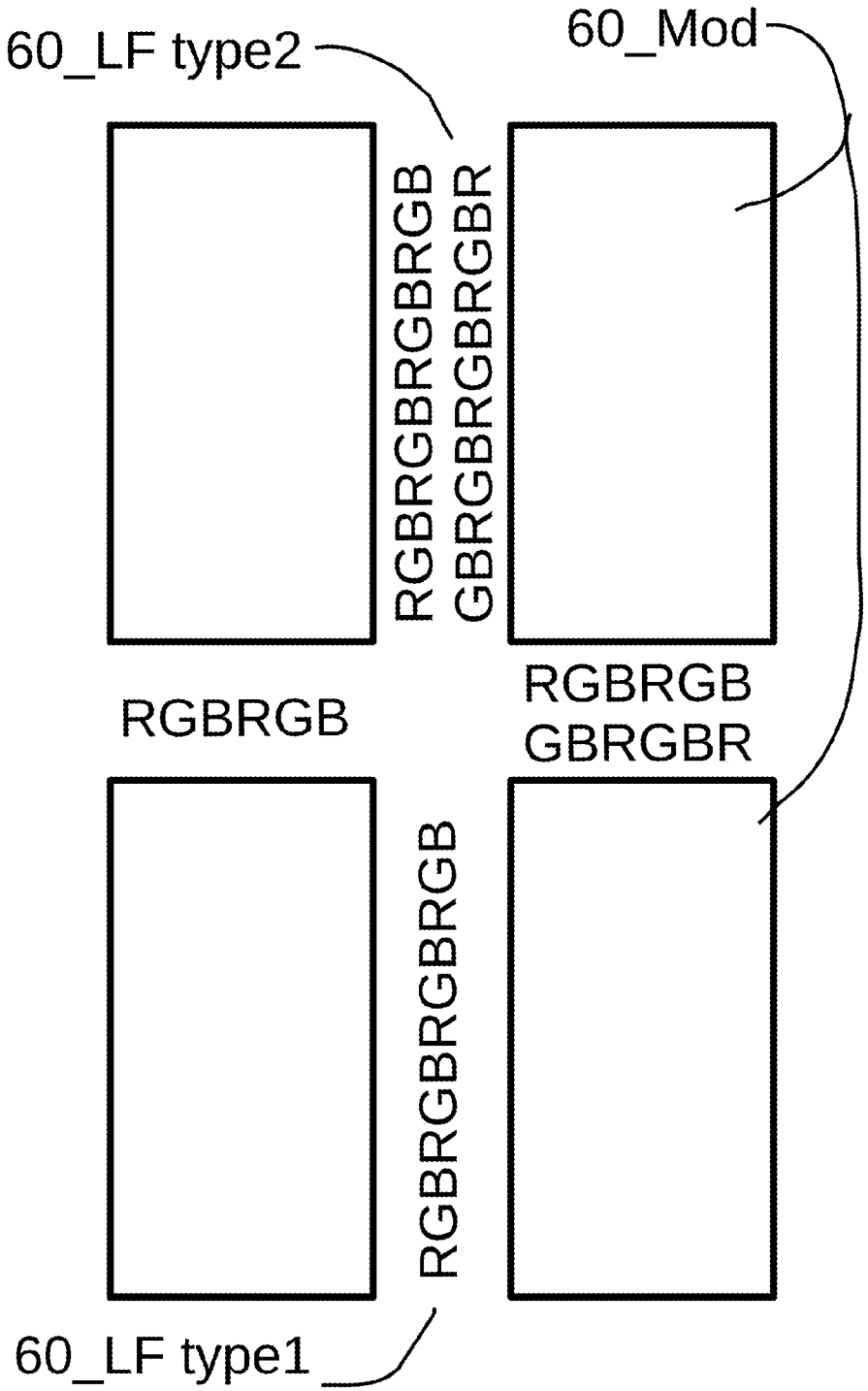

To forestall the image breaking seam lines between modules, the invention discloses a plurality of light elements 60_RGB behind the display surface (FIG. 16), preferably piping the light to the front surface 60_BBfront with optical fibers 60_Fiber, due to space constraints (FIGS. 16, 17 and 18). It is to be noticed that plastic optical fibers are fairly inexpensive, and though they cannot be used for long-distance optical fiber communications because plastic optical fibers leak like a sieve, they serve wonderfully for a few inches long light pipe running from the LEDs behind the display modules to the module's front surface 60_BBfront (FIGS. 16, 17 and 18). This inventive solution of optical fibers 60_fiber is not necessary, light emitting elements directly positioned at the seams, or display joint, or fastener, 60_Fastener, being also possible and covered by the invention too. The light emitted from the RGB elements in 18 can originate from the endings of optical fibers 60_Fiber or can originate from LEDs or any other light emitter. These pixels located at the front surface 60_Bbfront and 60_Fastener form the second partial image, which is an integral part of the total image.

FIG. 16A depicts a side view of a billboard or any other tiled flat panel display or their equivalents. In FIG. 16A the vertical line at the right represents the display surface seen from its side, with the light producing elements pointing to the right from 60_BBfront, emitting light towards the right side of the figure. The invention discloses a plurality of light emitting elements 60_RGB, e.g., red, green and blue (RGB) LEDs, which, for lack of space, are stacked in any way necessary, as shown in FIG. 16. The light emitted by these light emitting elements 60_RGB is then collected onto a plurality of optical fibers 60_fiber arranged as necessary, possibly using a light catcher 60_LC to direct a maximum amount of light into the optical fibers. The plurality of optical fibers 60_fibers is then possibly congregated into a thicker bundle, this step just for convenience, which is at the other end opened into the individual optical fibers again, and in such a way that the light output end of the optical fibers follow a pre-determined positional arrangement, as a line 60_LF of RGB, which line fills the space between the display modules 60_Mod (FIGS. 16B, 17 and 18A and 18B). FIG. 16B depicts a front view of the billboard or the flat panel display, or any of the variations. In this FIG. 16B we see a small display composed of two rows and three columns of modules, with a total of six display modules, with light fillers along one line 60_LF on all sides of each module. For the main embodiment, which uses optical fibers, the optical fibers 60_Fiber in FIG. 16B penetrate through the supporting structure 60_Fastener through holes 60_Holes, from where the light carried by the fibers 60_Fiber are emitted forward from the supporting structure 60_Fastener creating the second partial image.

Depending on the size of the space between the display modules, there may exist space for only a single line of optical fibers, or, if the gap is larger, for a double line of optical fibers, or for three lines of optical fibers, or for actual LEDs, etc., the particular solution being adjusted to the situation, the invention being only the light filler in any of its incarnations, so all these possibilities are intended to be covered by out invention. FIG. 17 displays two of these possibilities, indicated there as type 1 (one line of multi-colored pixels) and type 2 (two lines of multi-colored pixels), many other possibilities being possible which are intended to be covered by this invention.

FIGS. 18A and 18B show one type of supporting structure 60_Fastener that holds two modules 60_Mod together (which is part of the existing devices or old art to use the patent attorney's language), while having the added new feature of this invention of also supporting light fillers 60_LF. FIG. 18A shows the invention in the context of two modules, while FIG. 18B shows the details of the main embodiment of our invention, which is the insertion of lights in the existing mechanical structure to fill in the surface that is devoid of light in existing devices or prior art. The main embodiment of our invention uses optical fibers 60_Fiber to carry the light to the crowded space of the module fasteners 60_Fastener (as shown), but in principle the same thing can be done with LEDs directly at the light fillers 60_LF. We arbitrarily call as distal extremity of each optical fiber as the extremity ejecting light at the face of the display, and proximal extremity of each optical fiber as the extremity where light is injected into the fiber. Fiber optics are a preferable device and means to bring the second partial image to the location of the second partial image because the location of the second partial image (which is part of the total image, composed of a combination of the first partial image and the second partial image) is exactly the supporting structure of the device, the physical integrity of which should not be compromised. In turn, the protection of the physical integrity of the supporting structure (60_Fastener, etc.) requires that the orifices from which the pixel light is emitted forward be as small as possible, which is the reason for the fiber optics as light carrier, as the fiber diameter is generally smaller than the LED diameter. Our invention therefore discloses optical fibers ending at 60_Fastener and/or other equivalent locations, perpendicular to the image surface, but our invention is not limited to optical fiber as the light carrier. Likewise, our invention is not limited to a single line of RGB, as seen in FIGS. 18A and 18B, which is an example for an extremely narrow supporting structure, other arrangements of the RGB elements being included in our invention.

Alternative possibilities, which are also contemplated, are (1) not drill holes through the supporting structure 60_Fastener, but instead to bend the fiber optics around 60_Fastener then pointing the fiber optics forward, or (2) to have LEDs fixed on the face of the supporting structure (60_Fastener and/or others), which also would not require holes on 60_Fastener. The front surface of the support 60_Fastener may alternatively be covered by a scattering plastic, glass, or similar material, while light could be injected on this scattering plastic from its side, either with fiber optics or directly from LED, lasers, or any other source; in this case the scattering plastic, glass, or similar material would act as light source to form the second partial image. _Alternatively, instead of a scattering body, which would scatter forward part of the light injected in this scattering body, the forward surface of the support 60_Fastener could be covered by a plurality of mirrors, perhaps at 45 degree angle, which would reflect light rays injected parallel to the image surface to the forward direction, as desired. The angle of the orientation of the mirrors would be 45 degrees if the light beam were parallel to the image surface, but would be different than 45 degrees if the light beam were not parallel to the image surface. Or it could be a single, long mirror, along the main direction of the support 60_Fastener, at 45 degree angle with the front surface of 60_Fastener, which would be illuminated by a plurality of light rays from the side, then reflecting the light towards the forward direction, as required. A long mirror would be less expensive to make than a plurality of smaller mirrors, one for each pixel, and also easier to fasten in place than a plurality of smaller mirrors. Three or more of these long mirrors could be located at different "heights", that is, at different distances from the front surface or 60_Fastener, so that they would not be in each other way, one long mirror for each of the colors used for the image (usually RGB). Or the same mirror could be used to reflect first the R pixels, then the G pixels, then the B pixels. Many variations are possible still covered by our invention.

Still another alternative possibility is to collect all the proximal extremities of all the optical fibers corresponding to one of the (usually) three colors, say, the color red, at a line, at a fixed line at a fixed location, but with not necessarily with any linear organization regarding the distribution of the distal extremity at the supporting structure ending. A separate calibration, which would measure the linear position of the fibers at the proximal extremity and associate each of these to one particular space position at the distal extremity, which calibration would be associated with the particular fiber bundle and used by the computer to scan the line of fibers in such a way that the light entering each fiber at the line of fibers at the proximal extremity would produce the desired light intensity at the corresponding space position at the distal extremity. In other words, the line which contains the proximal extremities of the optical fibers could then be scanned by a light beam of the appropriate color (red in this example) from a single light source, or from two light sources dividing the job, etc. The light source would then be intensity modulated (a technical expression that means that it would suffer intensity variation in time while it scans the proximal extremity of the optical fibers), the modulation being adjusted so that as the beam enters each fiber, the beam would have the light intensity (brightness) corresponding to the desired light intensity at the exit point at the distal extremity of that particular fiber, which is the pixel corresponding to that point on the second partial image. As said above, for this to be possible, the controlling computer would necessitate having a map of each liner position at the proximal extremity to the distal position of the fiber at the supporting structure, that is, to the position of the fiber at the second partial image space. At the usual rate of a few dozens frames per second, the illumination time for each optical fiber would be several milliseconds, an easy task for both LEDs and laser sources, which can be easily modulated much faster than the required millisecond time (kHz frequency range). The same process would be repeated for the other colors (say, green and blue). In this possibility the optical fibers would not necessarily, and actually would preferably, be following the same order as they follow at the distal extremity, a process that would add to the manufacturing cost; the optical fibers could be gathered at random at the_linear arrangement at the proximal extremity, and an intermediate process of calibrating the linear proximal extremity would take place, where each optical fiber bundle would have their own calibration, which would be a map associating the first optical fiber at the line to a particular position on the second partial partial image surface, the second optical fiber at the line to another position on the second partial image, the third optical fiber at the line to another particular position on the second partial image surface, etc., which would then be passed on to the controlling computer, which would then modulate the light intensity along the line presented to the light beam according to the position of the fiber at the image site (the distal extremity of the fibers), which would be different than the linear sequence on the proximal extremity of the fibers, near the light sources. In this possibility the light source could be a laser source, instead of an LED, to simplify the coupling of the light beam to the optical fiber entrance at the proximal extremity. A laser would be preferable but not mandatory, an LED or even an incandescent lamp being possible too, though an incandescent lamp would not do for the required speed of intensity modulation.

Another possible variation/enhancement of the invention is to cover the supporting structure 60_Fastener with a covering sheet-like structure populated with light emitting devices to produce the second partial image, that is, with a covering structure fitted with some appropriate light emitting pixel distributed on its surface, which emits light in a pixelized structure, towards the same direction and with similar structure as the pixels on the display modules that form the first partial image. FIG. 16B shows one example of this variation, if the the light filler 60_LF were such covering structure over the supporting structure 60_Fastener. FIG. 17 shows other variations of such covering structures. Such cover would then make the second partial image, completing the total image the same way as the optical fibers would. Such cover may preferably be fitted with a pixel distribution of the same density and type as the density and type used for the modules 60_Mod. It is not necessary that the pixel density on this cover is the same as the pixel density used in the modules 60_Mod, because even if the pixel density were smaller, due to mechanical limitations, etc., the overall image on the display surface would still be better than with the image displayed by a bare supporting structure 60_Fastener. Likewise, if the pixel density on this cover were larger than the pixel density on the modules 60_Mod, the total image would be not worse than if it were only the same pixel density as the modules 60_Mod.

Likewise, it is not necessary that the type, or the technology, adopted for the pixels on this covering structure that covers the supporting structure 60_Fastener be the same as the type, or technology, used for the modules. This variation would need no optical fiber and the structure behind the display surface, and there would still be image continuity across the whole display surface. In other words, this variation would produce the second partial image with another variation of the modules which would be generally elongated to cover the supporting structure 60_Fastener, as needed for the particular structure. Accordingly, the pixels on such a covering sheet-like structure populated with light emitting devices could be made with LEDs, with LCDs, or with any of the possible technologies used for pixelized displays.

Another possible variation/enhancement on the invention is seen at FIG. 19. FIG. 19 displays one of the possibilities for the ending of the optical fiber. In this case the optical fiber ending is a polished concave surface which causes that the light piped through it leaves the fiber on a divergent pattern. Other possibilities are feasible and intended to be covered by the invention, as a convex exit surface, from which light is emitted in a converging beam, but a beam that diverges after the focal point (isn't this interesting?), or a flat exit surface from which light is emitted in a parallel beam, not diverging beam, not converging beam. It is also possible to have the exit surface not polished, which would cause that every exit point from the optical fiber ending acts as a scattering center, from which light emanates on all directions. These possibilities enhance the use of the invention, adapting it to the necessity of each particular case, depending on the position of the potential viewers with respect to the display surface.

The variation of light intensity at each of the plurality of light emitting device pixels is controlled by a computer of the class generally known as a desktop computer potentially aided by a plurality of micro-controllers. The local desktop computers and micro-controllers may be in turn remotely controlled by a more powerful computer which may be connected to the local computers by the Internet. Another possibility is that the connection between the display device and the controlling computer, and/or between several controlling computer and microcontrollers and electronics can be implemented using wireless connection. All these computers need interface with human beings, which can occur either using a command language similar to DOS, if incompetently implemented, or to UNIX, if designed by competent software engineers, or, alternatively, using a Xwindows environment, as a GUI. FIG. 20 shows a typical windows-type environment designed to select the color of individual pixels (as shown, selecting pixel (4,3)), or to automatically display any pre-selected text, or drawing, or figure, simply using copy and past instructions, as commonly used by such systems as Libre Office Writer, Libre Office Draw, etc.

Hexagons are not the only figure which completely fills the 2-D space, the others being the equilateral triangle, the square, and the rectangle. Any of these shapes can be used for the modules. It is also possible to use modules that differ from these, as pentagons, heptagons, etc. Though these do not completely fill a 2-D space, smaller triangles could be used to fill in the open spaces between the modules. Though such an arrangement would probably be more costly than the main embodiment, it is still feasible and it offers another option for the objective of interrupting the line of light emitters.

It is also simple to use the natural scrambling inherent to the hexagonally shaped modules, as shown in FIGS. 13, 14 and 15. FIG. 13 scrambles the horizontal line continuation simply for using hexagonally shaped modules, but does not scrambles the vertical line continuation. A slight variation from FIG. 13, just displacing the rows sideways (left-right) is enough to also break the line continuation along the vertical direction. And finally hexagonal modules with hexagonal close-packed pixels intrinsically prevents the formation of horizontal and vertical lines.

SEQUENCE LISTING

Not applicable

The invention claimed is:

1. A method for displaying images on an apparatus, the method comprising:

Controlling an electronics control unit to adjust an image state and a brightness of a plurality of a first light emitting pixels to create a first partial image and adjusting an image state and a brightness of a plurality of second light emitting pixels to create a second partial image;

Driving the plurality of the first light emitting pixels in fixed positions within a plurality of "n" display modules; such that the plurality of "n" display modules create part of a total display surface of the apparatus, where "n" is larger or equal than two and wherein the plurality of first light emitting pixels within the plurality of "n" display modules creates a display surface for each of the plurality of "n" display modules;

a supporting structure separate from the plurality of "n" display modules for arranging the plurality of "n" display modules in a fixed position to form part of the total display surface; further arranging the plurality of "n" display modules to be located adjacent to each other forming part of the display surface of the apparatus and the supporting structure further supporting the plurality of second light emitting pixels between the adjacent plurality of "n" display modules;

driving the plurality of second light emitting pixels directly located on the surface of the supporting structure to form the second partial image and wherein portions of the supporting structure containing the plurality of second light emitting pixels surrounds an outer edge of the display surface of each of the plurality of "n" display modules;

driving the combination of the plurality of first and second light emitting pixels, forming the first partial image and the second partial image, creating a total image on the display surface of the apparatus.

2. The method for displaying images on an apparatus according to claim 1, wherein the plurality of second light emitting pixels are a distal extremity of a plurality of optical fibers.

3. The method for displaying images on an apparatus according to claim 2, wherein a proximal extremities of the optical fibers and the distal extremities of the optical fibers are randomly arranged, with a map which associates each position of the distal extremity of each optical fiber to the position of the proximal extremity of the same fiber.

4. The method for displaying images on an apparatus according to claim 1, wherein the second plurality of light emitting pixels is a plurality of LEDs attached to a sheet-like structure mounted on the surface of the supporting structure.

5. The method for displaying images on an apparatus according to claim 1, wherein the second plurality of light emitting pixels is a plurality of LCDs attached to a sheet-like structure mounted on the surface of the supporting structure.

6. The method for displaying images on an apparatus according to claim 1, wherein the first plurality of light emitting pixels and the second plurality of light emitting device pixels may include pixels comprising of red pixels, blue pixels, green pixel and white pixels.

7. The method for display images on an apparatus according to claim 1, wherein the plurality of first light emitting pixels and second light emitting pixels are of the same type or different type of pixels.

8. An apparatus to display images, wherein the apparatus comprises:

A plurality of "n" display modules, such that the plurality of "n" display modules create part of a total display surface of the apparatus, where "n" is larger or equal than two;

wherein each of the plurality of "n" display modules comprise a plurality of first light emitting pixels in fixed positions within each of the plurality of "n" display modules creating a display surface for each of the plurality of "n" display modules;

wherein the display surface of each of the plurality of "n" display modules provides a portion of a first partial image;

a supporting structure separate from the plurality of "n" display modules to arrange the plurality of "n" modules in a fixed position to form part the total display surface;

the supporting structure comprising a plurality of second light emitting pixels directly located on the surface of the supporting structure and wherein portions of the supporting structure containing the plurality of second light emitting pixels surrounds an outer edge of the display surface of each of the plurality of "n" display modules;

wherein the supporting structure provides mechanical support causing the plurality of "n" display modules to be located adjacent to each other forming part of the display surface of the apparatus and the supporting structure further supporting the plurality of second light emitting pixels between the adjacent plurality of "n" display modules forming a second partial image;

an electronics control unit controlling an image state and a brightness of the plurality of the first light emitting pixels in each of the plurality of "n" display modules to create the first partial image; the electronics control unit further controlling an image state and a brightness of the plurality of second light emitting pixels to create the second partial image;

wherein the combination of the first partial image and the second partial image forms a total image on the display surface of the apparatus.

9. The apparatus of claim 8, wherein the plurality of second light emitting pixels are a distal extremity of a plurality of optical fibers.

10. The apparatus of claim 9, wherein a proximal extremities of the optical fibers and the distal extremities of the optical fibers are randomly arranged, with a map which associates each position of the distal extremity of each optical fiber to the position of the proximal extremity of the same fiber.

11. The apparatus of claim 8, wherein the second plurality of light emitting pixels is a plurality of LEDs attached to a sheet-like structure mounted on the surface of the supporting structure.

12. The apparatus of claim 8, wherein the second plurality of light emitting device pixels is a plurality of LCDs attached to a sheet-like structure mounted on the surface of the supporting structure.

13. The apparatus of claim 8, wherein the first plurality of light emitting device pixels and the second plurality of light emitting device pixels may include pixels comprising of red pixels, blue pixels, green pixel and white pixels.

14. The apparatus of claim 8, wherein the plurality of first light emitting pixels and second light emitting pixels are of the same type or different type of pixels.

15. A non-transitory computer program product for use in a computer system used for controlling an apparatus to display images, wherein the apparatus comprises:

A plurality of "n" display modules, such that the plurality of "n" display modules create part of a total display surface of the apparatus, where "n" is larger or equal than two;

wherein each of the plurality of "n" display modules comprise a plurality of first light emitting pixels in fixed positions within each of the plurality of "n" display modules creating a display surface for each the plurality of "n" display modules;

wherein the display surface of each of the plurality of "n" display modules provides a portion of a first partial image;

a supporting structure separate from the plurality of "n" display modules to arrange the plurality of "n" display modules in a fixed position to form part the total display surface;

the supporting structure comprising a plurality of second light emitting pixels directly located on the surface of the supporting structure and wherein portions of the supporting structure containing the plurality of second light emitting pixels surrounds an outer edge of the display surface of each of the plurality of "n" display modules;

wherein the supporting structure provides mechanical support causing the plurality of "n" display modules to be located adjacent to each other forming part of the display surface of the apparatus and the supporting structure further supporting the plurality of second light emitting pixels between the adjacent plurality of "n" display modules forming a second partial image;

an electronics control unit controlling an image state and a brightness of the plurality of the first light emitting pixels in each of the plurality of "n" display modules to create the first partial image; the electronics control unit further controlling an image state and a brightness of the plurality of second light emitting pixels to create the second partial image;

wherein the combination of the first partial image and the second partial image forms a total image on the display surface of the apparatus.

16. The non-transitory computer program product for use in a computer system used for controlling an apparatus to display images of claim 15, wherein the plurality of second light emitting pixels are a distal extremity of a plurality of optical fibers.

17. The non-transitory computer program product for use in a computer system used for controlling an apparatus to display images of claim 16, wherein a proximal extremities of the optical fibers and the distal extremities of the optical fibers are randomly arranged, with a map which associates each position of the distal extremity of each optical fiber to the position of the proximal extremity of the same fiber.

18. The non-transitory computer program product for use in a computer system used for controlling an apparatus to display images of claim 15, wherein the second plurality of light emitting pixels is a plurality of LEDs attached to a sheet-like structure mounted on the surface of the supporting structure.

19. The non-transitory computer program product for use in a computer system used for controlling an apparatus to display images of claim 15, wherein the second plurality of light emitting device pixels is a plurality of LCDs attached to a sheet-like structure mounted on the surface of the supporting structure.

20. The non-transitory computer program product for use in a computer system used for controlling an apparatus to display images of claim 15, wherein the first plurality of light emitting device pixels and the second plurality of light emitting device pixels may include pixels comprising of red pixels, blue pixels, green pixel and white pixels.

* * * * *